US010234818B2

(12) United States Patent
Itabashi

(10) Patent No.: US 10,234,818 B2
(45) Date of Patent: Mar. 19, 2019

(54) DEVELOPING CARTRIDGE HAVING ARRANGEMENT OF CHIP HOLDER AND COUPLING TO PROVIDE COMPACT CARTRIDGE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/936,612

(22) Filed: Mar. 27, 2018

(65) Prior Publication Data

US 2018/0373195 A1 Dec. 27, 2018

(30) Foreign Application Priority Data

Jun. 23, 2017 (JP) ..... 2017-122904

(51) Int. Cl.
*G03G 15/08* (2006.01)
*G03G 21/16* (2006.01)
(Continued)

(52) U.S. Cl.
CPC ..... *G03G 21/1676* (2013.01); *G03G 15/0147* (2013.01); *G03G 15/0865* (2013.01);
(Continued)

(58) Field of Classification Search
CPC ..... G03G 21/1676
(Continued)

(56) References Cited

U.S. PATENT DOCUMENTS

2011/0064457 A1 3/2011 Okabe et al.
2012/0200871 A1* 8/2012 Takahashi ..... G03G 21/1652 358/1.9
(Continued)

FOREIGN PATENT DOCUMENTS

EP 2 919 074 A1 9/2015
JP 9-190058 A 7/1997
(Continued)

OTHER PUBLICATIONS

International Search Report and Written Opinion issued in related International Patent Application No. PCT/JP2018/012300, dated May 15, 2018.
(Continued)

*Primary Examiner* — Quana M Grainger
(74) *Attorney, Agent, or Firm* — Merchant & Gould P.C.

(57) ABSTRACT

A developing cartridge includes: a casing; a developing roller; a storage medium; a first holder; a second holder; and a coupling. The developing roller is positioned at one end portion of the casing in a first direction. The first holder has an outer surface at which an electrical contact surface of the storage medium is held. The second holder is positioned away from the first holder in a direction crossing the electrical contact surface. The first holder and the second holder are movable relative to the casing and the coupling between a first position and a second position in the first direction. The second position is closer to the developing roller than the first position. A portion of the coupling is positioned between the first holder and the second holder in a case where the first holder and the second holder are positioned at the second position.

32 Claims, 16 Drawing Sheets

(51) Int. Cl.
*G03G 21/18* (2006.01)
*G03G 15/01* (2006.01)

(52) U.S. Cl.
CPC ..... *G03G 21/1623* (2013.01); *G03G 21/1647* (2013.01); *G03G 21/1864* (2013.01); *G03G 15/0121* (2013.01); *G03G 2215/0177* (2013.01); *G03G 2221/163* (2013.01)

(58) Field of Classification Search
USPC ..... 399/119
See application file for complete search history.

(56) References Cited

U.S. PATENT DOCUMENTS

| | | | | |
|---|---|---|---|---|
| 2013/0051849 | A1 | 2/2013 | Itabashi et al. | |
| 2014/0348533 | A1 | 11/2014 | Eto | |
| 2015/0037050 | A1* | 2/2015 | Kimura | G03G 21/1885 399/12 |
| 2015/0139688 | A1 | 5/2015 | Leemhuis et al. | |
| 2015/0212482 | A1 | 7/2015 | Wakimoto | |
| 2015/0261177 | A1 | 9/2015 | Moon et al. | |
| 2015/0261181 | A1 | 9/2015 | Moon et al. | |
| 2017/0184998 | A1* | 6/2017 | Itabashi | G03G 15/0865 |
| 2017/0269544 | A1* | 9/2017 | Itabashi | G03G 21/1676 |
| 2018/0181055 | A1* | 6/2018 | Itabashi | G03G 21/1652 |
| 2018/0284647 | A1* | 10/2018 | Yokoi | G03G 15/0863 |

FOREIGN PATENT DOCUMENTS

| | | | |
|---|---|---|---|
| JP | 2008-242084 | A | 10/2008 |
| JP | 2011-059510 | A | 3/2011 |
| JP | 2012-234190 | A | 11/2012 |
| JP | 2013-054058 | A | 3/2013 |
| JP | 2014-170144 | A | 9/2014 |

OTHER PUBLICATIONS

Extended European Search Report issued in related European Patent Application No. 18714421.7, dated Dec. 17, 2018.

* cited by examiner

DEVELOPING CARTRIDGE HAVING ARRANGEMENT OF CHIP HOLDER AND COUPLING TO PROVIDE COMPACT CARTRIDGE

CROSS REFERENCE TO RELATED APPLICATION

This application claims priority from Japanese Patent Application No. 2017-122904 filed Jun. 23, 2017. The entire content of the priority application is incorporated herein by reference.

TECHNICAL FIELD

The present disclosure relates to a developing cartridge.

BACKGROUND

There is conventionally known an electro-photographic type image forming apparatus such as a laser printer and an LED printer. One such image forming apparatus uses a developing cartridge including a developing roller for supplying toner. Prior art discloses a developing cartridge attachable to a drawer unit. The drawer unit is configured to be accommodated in the image forming apparatus and pulled out from the image forming apparatus. The drawer unit includes a photosensitive drum. The developing roller faces the photosensitive drum upon attachment of the developing cartridge to the drawer unit.

Another prior art discloses a developing cartridge configured to be attachable to a drum cartridge including a photosensitive drum. The developing roller faces the photosensitive drum upon attachment of the developing cartridge to the drum cartridge. The developing cartridge is attached to an image forming apparatus in a state where the developing cartridge is attached to the drum cartridge.

Further, a developing cartridge including a storage medium is known. An IC chip is one example of the storage medium. The storage medium has an electrical contact surface. The developing cartridge includes a holder for retaining the storage medium, and a coupling.

SUMMARY

Here, in a case where the holder and the coupling are positioned at one side of the developing cartridge and arrayed with each other, the resultant developing cartridge grows in size.

In view of the foregoing, it is an object of the disclosure to provide a compact developing cartridge.

In order to attain the above and other objects, according to one aspect, the disclosure provides a developing cartridge including: a casing; a developing roller; a storage medium; a first holder; a second holder; and a coupling. The casing is configured to accommodate developer. The developing roller is positioned at one end portion of the casing in a first direction. The developing roller is rotatable about a first axis extending in a second direction. The storage medium has an electrical contact surface. The first holder is movable in the first direction relative to the casing. The first holder has an outer surface at which the electrical contact surface is held. The second holder is movable together with the first holder in the first direction relative to the casing. The second holder is positioned away from the first holder in a third direction crossing the electrical contact surface. The coupling is rotatable about a second axis extending in the second direction. The coupling is rotatable together with the developing roller. The first holder and the second holder are movable relative to the casing and the coupling between a first position in the first direction and a second position in the first direction. The second position is positioned closer to the developing roller than the first position is to the developing roller. A portion of the coupling is positioned between the first holder and the second holder in a case where the first holder and the second holder are positioned at the second position.

According to another aspect, the disclosure provides a developing cartridge including: a casing; a developing roller; a storage medium; a first holder; a second holder; and a coupling. The casing is configured to accommodate developer. The developing roller is positioned at one end portion of the casing in a first direction. The developing roller is rotatable about a first axis extending in a second direction. The storage medium has an electrical contact surface. The first holder is movable in the first direction relative to the casing. The first holder has an outer surface at which the electrical contact surface is held. The second holder is movable together with the first holder in the first direction relative to the casing. The second holder is positioned away from the first holder in a third direction crossing the electrical contact surface. The coupling is rotatable about a second axis extending in the second direction. The coupling is rotatable together with the developing roller. One of the first holder and the second holder has a through-hole extending in the second direction. The first holder and the second holder is movable in the first direction relative to the casing and the coupling in a state where the coupling is inserted into the through-hole.

According to still another aspect, the disclosure provides a developing cartridge including: a casing; a developing roller; a storage medium; a first holder; a second holder; a coupling; and a resilient member. The casing is configured to accommodate developer. The developing roller is positioned at one end portion of the casing in a first direction. The developing roller is rotatable about a first axis extending in a second direction. The storage medium has an electrical contact surface. The first holder is movable in the first direction relative to the casing. The first holder has an outer surface at which the electrical contact surface is held. The second holder is movable together with the first holder in the first direction relative to the casing. The second holder is positioned away from the first holder in a third direction crossing the electrical contact surface. The coupling is rotatable about a second axis extending in the second direction. The coupling is rotatable together with the developing roller. The resilient member is positioned between the first holder and the second holder. The resilient member is configured to expand and/or contract in the third direction between a first state and a second state. The resilient member in the first state has a length in the third direction greater than a length in the third direction of the resilient member in the second state. One of the first holder and the second holder has a through-hole extending in the second direction. The first holder is movable in the third direction relative to the second holder between one position and another position in accordance with expansion and/or contraction of the resilient member in a state where the coupling is inserted into the through-hole. The first holder is positioned at the one position in a case where the resilient member is in the first state, and the first holder is positioned at the another position in a case where the resilient member is in the second state.

According to yet another aspect, the disclosure provides a developing cartridge including: a casing; a developing roller; a storage medium; a first holder; a second holder; a coupling; and a resilient member. The casing is configured to accommodate developer. The developing roller is positioned at one end portion of the casing in a first direction. The developing roller is rotatable about a first axis extending in a second direction. The storage medium has an electrical contact surface. The first holder is movable in the first direction relative to the casing. The first holder has an outer surface at which the electrical contact surface is held. The second holder is movable together with the first holder in the first direction relative to the casing. The second holder is positioned away from the first holder in a third direction crossing the electrical contact surface. The coupling is rotatable about a second axis extending in the second direction. The coupling is rotatable together with the developing roller. The resilient member is positioned between the first holder and the second holder. The resilient member is configured to change its length in the third direction to provide a first state and a second state. The resilient member in the first state has a length in the third direction greater than a length in the third direction of the resilient member in the second state. One of the first holder and the second holder has a through-hole extending in the second direction. The first holder is movable in the third direction relative to the second holder between one position and another position in accordance with change in length of the resilient member in a state where the coupling is inserted into the through-hole. The first holder is positioned at the one position in a case where the resilient member is in the first state, and the first holder is positioned at the another position in a case where the resilient member is in the second state.

According to yet another aspect, the disclosure provides a developing cartridge including: a casing; a developing roller; a storage medium; a first holder; a second holder; a coupling; and a resilient member. The casing is configured to accommodate developer. The developing roller is positioned at one end portion of the casing in a first direction. The developing roller is rotatable about a first axis extending in a second direction. The storage medium has an electrical contact surface. The first holder is movable in the first direction relative to the casing. The first holder has an outer surface at which the electrical contact surface is held. The second holder is movable together with the first holder in the first direction relative to the casing. The second holder is positioned away from the first holder in a third direction crossing the electrical contact surface. The coupling is rotatable about a second axis extending in the second direction. The coupling is rotatable together with the developing roller. The resilient member is positioned between the first holder and the second holder. The resilient member has any one of expansion properties for expanding in the third direction, contracting properties for contracting in the third direction, and expansion-contraction properties for expanding and contracting in the third direction to provide a first state and a second state. The resilient member in the first state has a length in the third direction greater than a length in the third direction of the resilient member in the second state. One of the first holder and the second holder has a through-hole extending in the second direction. The first holder is movable in the third direction relative to the second holder between one position and another position in accordance with any one of expansion, contraction, and expansion and contraction of the resilient member in a state where the coupling is inserted into the through-hole. The first holder is positioned at the one position in a case where the resilient member is in the first state, and the first holder is positioned at the another position in a case where the resilient member is in the second state.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. First Embodiment

Figure 1:
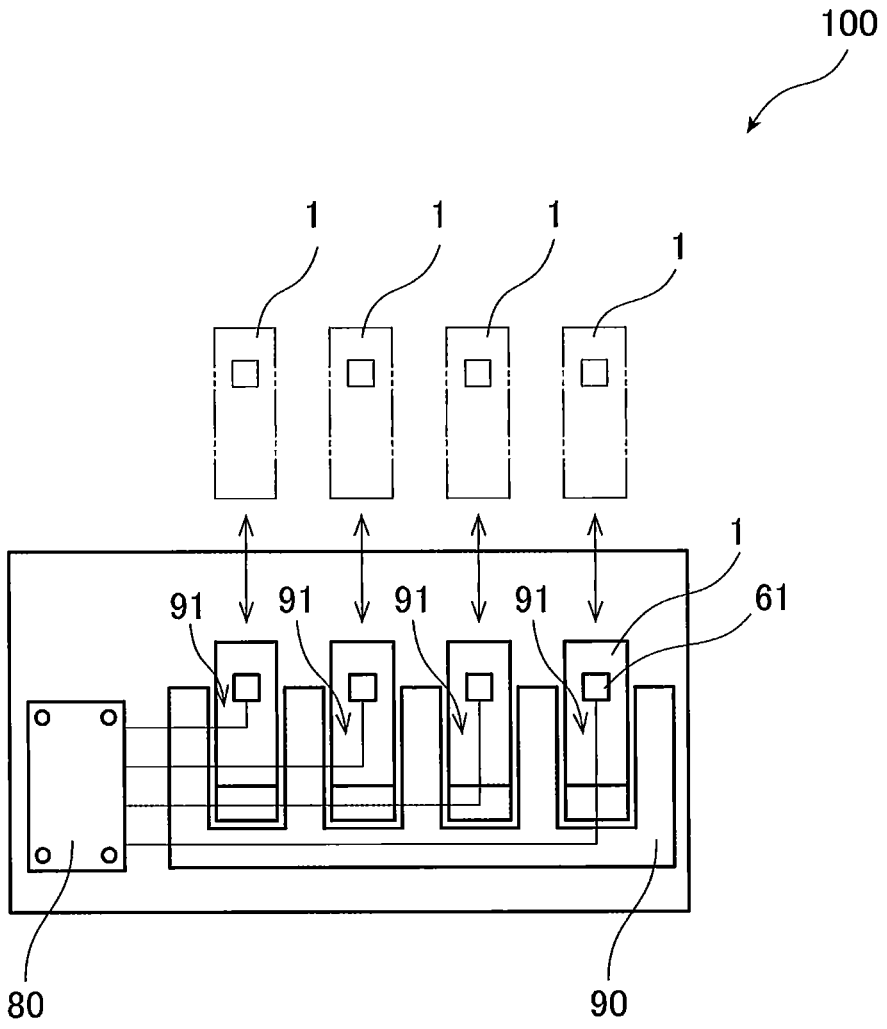
FIG. 1 is a conceptual diagram of an image forming apparatus.

A developing cartridge 1 according to a first embodiment will be described with reference to FIGS. 1 through 8, wherein like parts and components are designated by the same reference numerals to avoid duplicating description.

<1.1. Structure of Image Forming Apparatus>

FIG. 1 is a conceptual diagram of an image forming apparatus 100. The image forming apparatus 100 is an electro-photographic type printer. For example, the image forming apparatus 100 may be a laser printer or an LED printer. The image forming apparatus 100 includes four developing cartridges 1, and a drawer unit 90. The drawer unit 90 is a frame in which the four developing cartridges 1 can be mounted. The image forming apparatus 100 is configured to form an image on a recording surface of a printing sheet with developer (for example, toner) supplied from the four developing cartridges 1.

Figure 2:
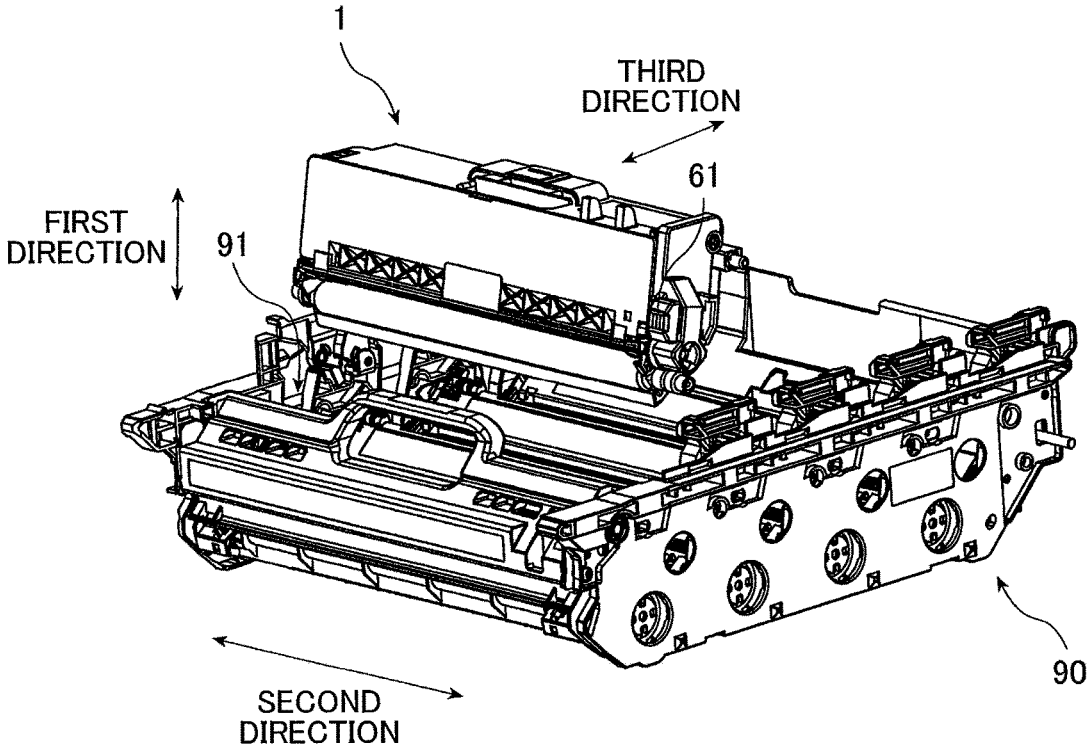
FIG. 2 is a perspective view of a drawer unit and a developing cartridge according to a first embodiment.

FIG. 2 is a perspective view of the drawer unit 90 and the developing cartridge 1. As illustrated in FIGS. 1 and 2, the four developing cartridges 1 are individually and replaceably attached to the drawer unit 90. The drawer unit 90 is pulled out through an opening (not illustrated) formed in a main casing of the image forming apparatus 100 to replace the developing cartridges 1. The drawer unit 90 has four slots 91. The developing cartridges 1 are attached to and detached from the corresponding slots 91. The drawer unit 90 includes four photosensitive drums that are not illustrated in the drawings. The photosensitive drums are positioned adjacent to bottom portions of the corresponding slots 91. Each of the photosensitive drums is rotatable about a rotational axis extending in a second direction described later.

In the present embodiment, four developing cartridges 1 are attached to a single drawer unit 90. The four developing cartridges 1 accommodate developer of different colors from each other (cyan, magenta, yellow, and black, for example). However, the number of developing cartridges 1 attached to the drawer unit 90 may be one, two, or three, or five or greater.

Each of the four developing cartridges 1 includes an integrated circuit (chip) 61 as an example of a storage medium. The chips 61 are readable and writable storage media. That is, information can be written to or read from the chips 61. The image forming apparatus 100 further includes a controller 80. When the four developing cartridges 1 are attached to the drawer unit 90, the chip 61 of each developing cartridge 1 becomes electrically connected to the controller 80. The controller 80 is configured of a circuit board, for example. The controller 80 includes a processer, such as a CPU, and various memories. The controller 80 is configured to execute various processes of the image forming apparatus 100 according to a program.

<1.2. Description of Developing Cartridge 1>

Figure 3:
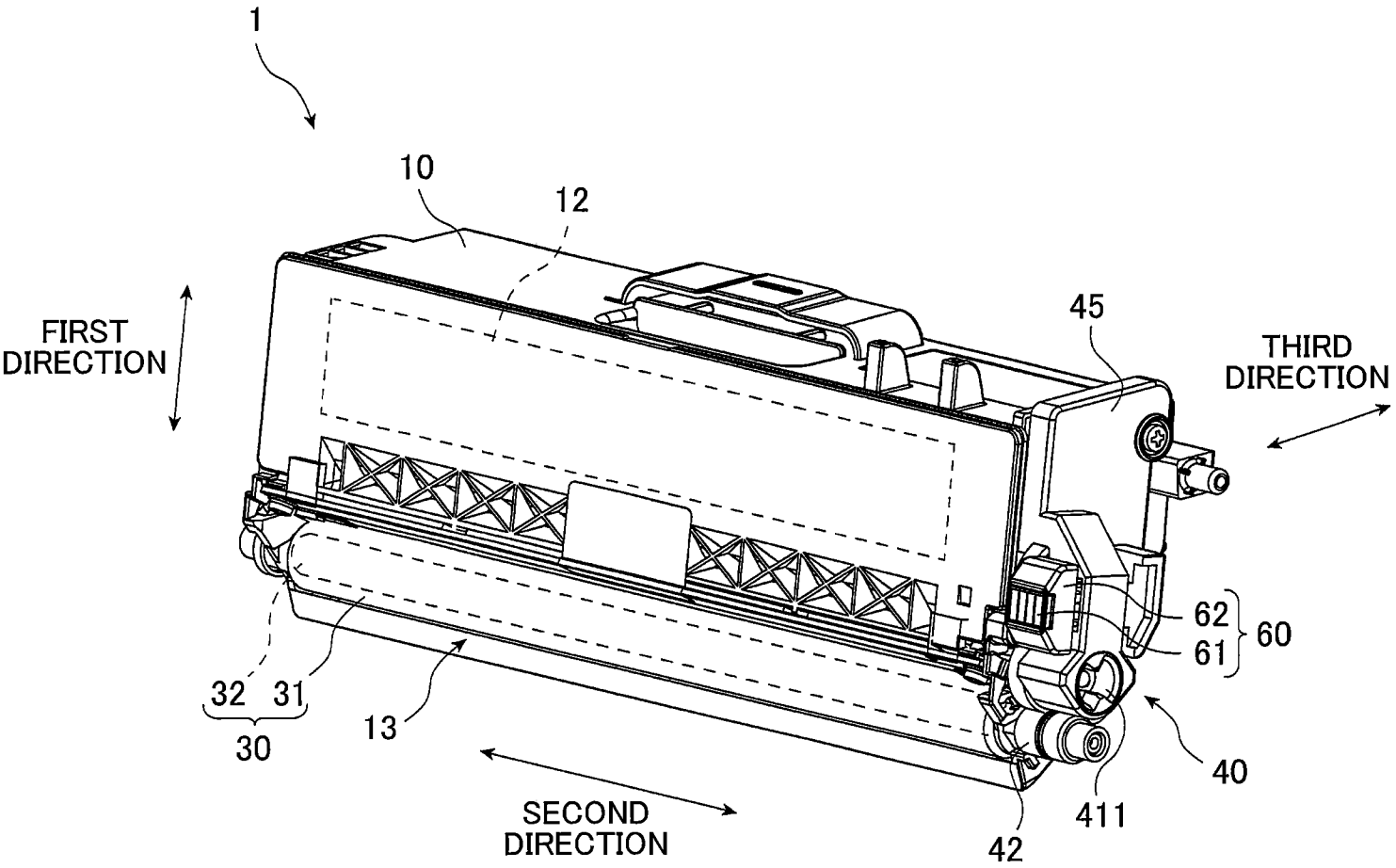
FIG. 3 is a perspective view of the developing cartridge according to the first embodiment.
Figure 4:
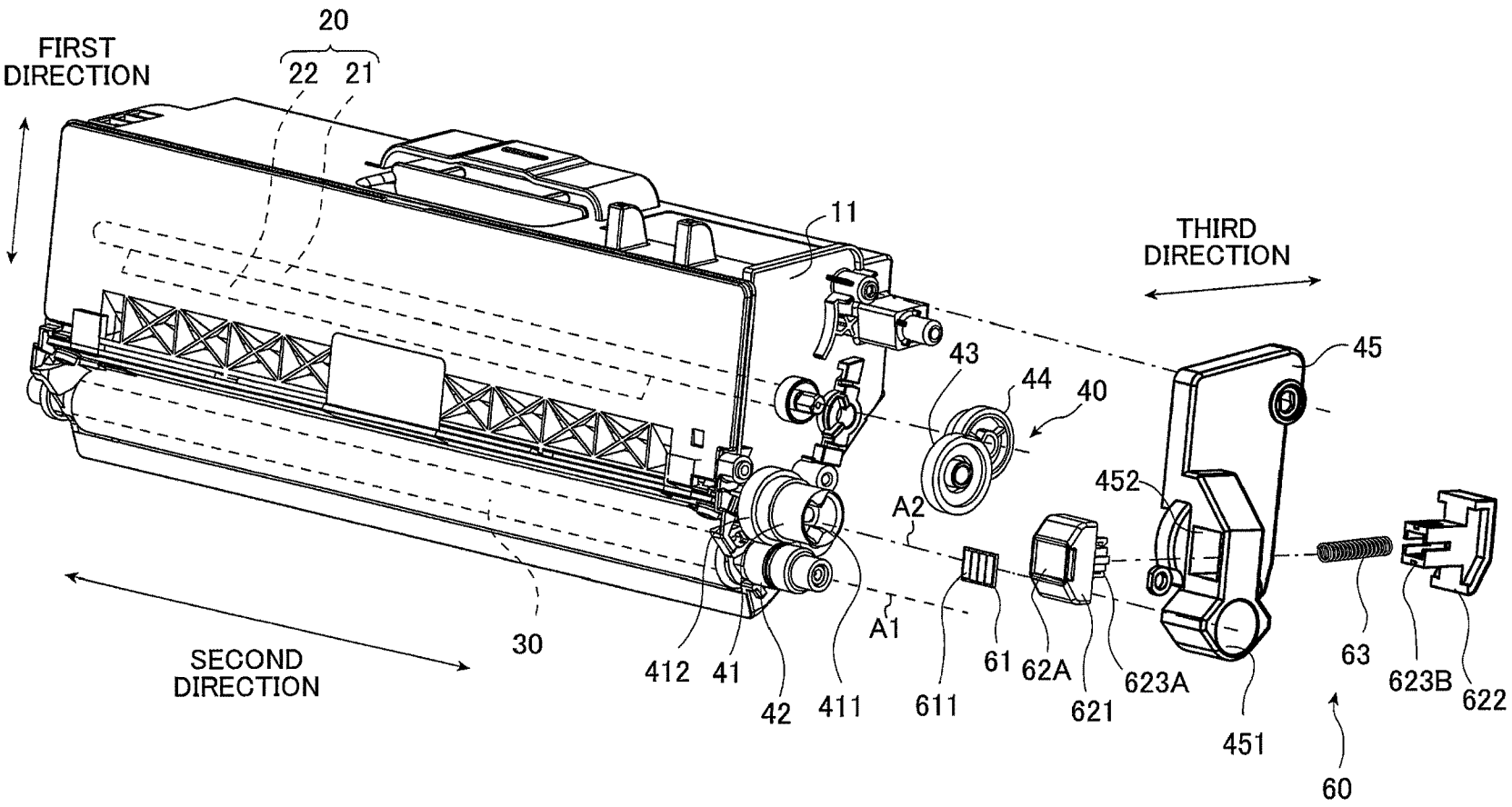
FIG. 4 is an exploded perspective view of the developing cartridge according to the first embodiment.

FIG. 3 is a perspective view of the developing cartridge 1 according to the first embodiment. FIG. 4 is an exploded perspective view of the developing cartridge 1 according to the first embodiment. As illustrated in FIGS. 3 and 4, the developing cartridge 1 includes a casing 10, a developing roller 30, a gear portion 40, and a chip assembly 60.

The casing 10 is a housing that can accommodate developer. The casing 10 is elongated in one direction. The developing roller 30 is positioned at one end portion of the casing 10 in a first direction. The developing roller 30 is rotatable about a first axis Al extending in a second direction. The second direction crosses the first direction. Preferably, the second direction is perpendicular to the first direction. Further, a third direction is defined as a direction crossing an electrical contact surface 611 (described later) of the chip 61. The third direction crosses the first direction and the second direction. Preferably, the third direction is perpendicular to the first direction and the second direction. Incidentally, the first direction coincides with an insertion direction in which the developing cartridge 1 is inserted into the drawer unit 90.

The casing 10 has a developer chamber 12 positioned inside the casing 10. The developer chamber 12 accommodates developer therein. The casing 10 has an opening 13. The developer chamber 12 communicates with an outside of the casing 10 through the opening 13. The opening 13 is positioned at one end portion of the casing 10 in the first direction. The developing roller 30 is positioned at the opening 13.

The developing roller 30 includes a roller body 31 and a roller shaft 32. The roller shaft 32 extends in the second direction. The roller body 31 is fixed to the roller shaft 32 so as to be incapable of rotating relative to the roller shaft 32. One end portion of the roller shaft 32 in the second direction is fixed to a developing-roller gear 42 (described later) so as to be incapable of rotating relative to the developing-roller gear 42. Hence, as the developing-roller gear 42 rotates, the roller shaft 32 rotates, and the roller body 31 rotates together with the roller shaft 32.

The developing cartridge 1 further includes a supply roller that is not illustrated in the drawings.

When the developing cartridge 1 receives a drive force, the supply roller supplies developer from the developer chamber 12 inside the casing 10 onto an outer circumferential surface of the developing roller 30. At this time, the developer is tribocharged between the supply roller and the developing roller 30. In the meantime, a bias voltage is applied to the roller shaft 32 of the developing roller 30. As a consequence, electrostatic force between the roller shaft 32 and the developer attracts the developer onto an outer circumferential surface of the roller body 31.

The developing cartridge 1 further includes a thickness-regulating blade that is not illustrated in the drawings. The thickness-regulating blade is configured to form the developer supplied onto the outer circumferential surface of the roller body 31 into a layer of uniform thickness. Subsequently, the developer on the outer circumferential surface of the roller body 31 is supplied onto the corresponding photosensitive drum positioned at the drawer unit 90. At this time, the developer moves from the roller body 31 onto the photosensitive drum in accordance with an electrostatic latent image formed on an outer circumferential surface of the photosensitive drum, thereby developing the electrostatic latent image into a visible image on the outer circumferential surface of the photosensitive drum.

One end portion of the casing 10 in the second direction has an outer surface 11. The gear portion 40 and the chip assembly 60 are positioned at the outer surface 11. As described later in detail, the gear portion 40 is positioned at the outer surface 11 so as to be movable together with the casing 10 relative to the chip assembly 60 in the first direction and the third direction. The chip assembly 60 is positioned at the outer surface 11 so as to be movable relative to the casing 10 and the gear portion 40 in the first direction and the third direction. That is, a coupling 41 described later is positioned at the outer surface 11 so as to be movable together with the casing 10 relative to chip assembly 60 in the first direction and the third direction. The chip assembly 60 is positioned at the outer surface 11 so as to be movable relative to the casing 10 and the coupling 41 in the first direction and the third direction.

As illustrated in FIG. 4, the gear portion 40 includes the coupling 41, the developing-roller gear 42, an idle gear 43, an agitator gear 44, and a first cover 45. Note that while each of the coupling 41, the developing-roller gear 42, the idle gear 43, and the agitator gear 44 has a plurality of gear teeth, the gear teeth are not illustrated in the drawings.

The coupling 41 is a member that initially receives a drive force supplied from the image forming apparatus 100. The coupling 41 is rotatable about a second axis A2 extending in the second direction. The coupling 41 has a fastening hole 411. The fastening hole 411 is a recessed portion that is recessed in the second direction. A coupling gear 412 is provided at the outer surface 11 of the casing 10. The coupling gear 412 is rotatable about the second axis A2. The coupling gear 412 has a plurality of gear teeth arranged at regular intervals around an entire outer circumferential surface of the coupling gear 412. The coupling 41 rotates together with the coupling gear 412 about the second axis A2. The coupling 41 and the coupling gear 412 may be integrally formed of resin or may be formed as separate members from each other. In the present embodiment, the coupling 41 and the coupling gear 412 are integrally formed.

When the drawer unit 90 with the developing cartridges 1 attached thereto is inserted into the image forming apparatus 100, a drive shaft (not illustrated) in the image forming apparatus 100 is inserted into the fastening hole 411 of each coupling 41. Through this operation, the drive shaft and the coupling 41 are coupled together so as to be incapable of rotating relative to each other. Hence, as the drive shaft rotates, the coupling 41 rotates, and the coupling gear 412 rotates together with the coupling 41.

The developing-roller gear 42 is a gear for rotating the developing roller 30. The developing-roller gear 42 is rotatable about the first axis Al extending in the second direction. The developing-roller gear 42 has a plurality of gear teeth arranged at regular intervals around an entire outer circumferential surface of the developing-roller gear 42. A portion of the plurality of gear teeth of the coupling gear 412 meshes with a portion of the plurality of gear teeth of the developing-roller gear 42. Further, the developing-roller gear 42 is mounted to the one end portion in the second direction of the roller shaft 32 of the developing roller 30 so as to be incapable of rotating relative to the roller shaft 32. Hence, as the coupling gear 412 rotates, the developing-roller gear 42 rotates, and the developing roller 30 rotates together with the developing-roller gear 42.

The idle gear 43 is a gear for transmitting the rotation of the coupling gear 412 to the agitator gear 44. The idle gear 43 is rotatable about a rotational axis extending in the second direction. As the coupling gear 412 rotates, the idle gear 43 rotates. As the idle gear 43 rotates, the agitator gear 44 also rotates.

The agitator gear 44 is a gear for rotating an agitator 20 inside the developer chamber 12. The agitator 20 includes an agitator shaft 21, and an agitating blade 22. The agitator shaft 21 has a rotational axis extending in the second direction, and is rotatable about the rotational axis. The agitating blade 22 extends radially outward from the agitator shaft 21. The agitating blade 22 is positioned inside the developer chamber 12 of the casing 10. The agitator gear 44 is mounted to one end portion of the agitator shaft 21 in the second direction. Hence, the agitator shaft 21 and the agitating blade 22 rotate together with the agitator gear 44. When the agitating blade 22 rotates, the agitating blade 22 agitates developer inside the developer chamber 12.

The agitator gear 44 is rotatable about the rotational axis extending in the second direction. The agitator gear 44 has a plurality of gear teeth arranged at regular intervals around an entire outer circumferential surface of the agitator gear 44. As a drive force is transmitted from the coupling 41 to the agitator gear 44 via the idle gear 43, the agitator gear 44 rotates, and the agitator 20 rotates together with the agitator gear 44.

The first cover 45 is fixed to the outer surface 11 of the casing 10 with at least one screw, for example. The coupling gear 412, the developing-roller gear 42, the idle gear 43, and the agitator gear 44 are accommodated in a space defined by the outer surface 11 and the first cover 45. The first cover 45 has a through-hole 451. The through-hole 451 penetrates the thickness of the first cover 45 in the second direction. The fastening hole 411 of the coupling 41 is exposed to an outside of the first cover 45 through the through-hole 451 of the first cover 45. The first cover 45 also functions as a holder cover that retains a chip holder 62 of the chip assembly 60 described later.

<1.3. Description of Chip Assembly>

The chip assembly 60 is positioned at the outer surface 11 of the casing 10. The chip assembly 60 is held by the first cover 45. The chip assembly 60 includes the chip 61 serving as a storage medium, and the chip holder 62 that retains the chip 61.

The chip 61 is configured to store various information related to the developing cartridge 1. The chip 61 has the electrical contact surface 611. The electrical contact surface 611 is formed of metal functioning as electric conductor. The chip 61 is fixed to an outer surface 62A of the chip holder 62 in the third direction. Only the electrical contact surface 611 may be fixed to the outer surface 62A of the chip holder 62, while an electrical circuit of the chip 61 may be disposed at a position other than the outer surface 62A.

The drawer unit 90 includes electrical connectors that are not illustrated in the drawings. The electrical connectors are formed of metal, for example. When the developing cartridge 1 is attached to the drawer unit 90, the electrical contact surface 611 is brought into contact with the electrical connector of the drawer unit 90. Contact between the electrical contact surface 611 and the electrical connector of the drawer unit 90 enables the image forming apparatus 100 to read information from the chip 61 or to write information to the chip 61.

Figure 5A:
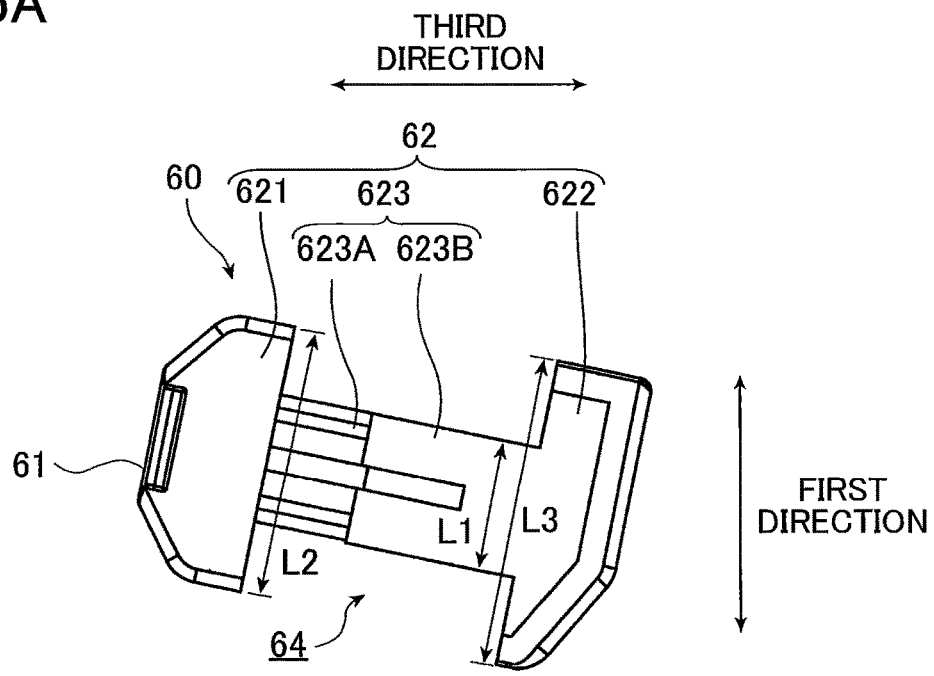
FIG. 5A is a view illustrating a chip assembly as viewed in a second direction.
Figure 5B:
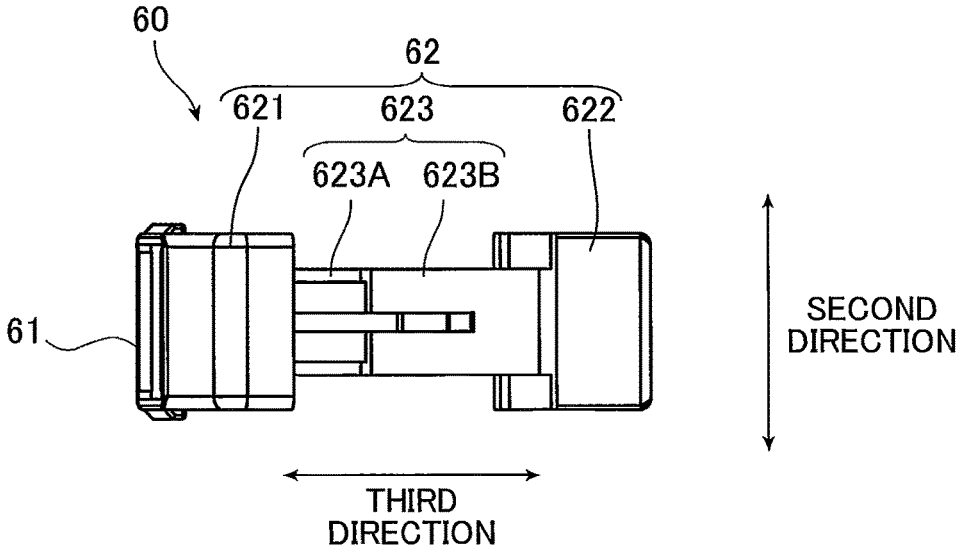
FIG. 5B is a view illustrating the chip assembly as viewed in a first direction.
Figure 6:
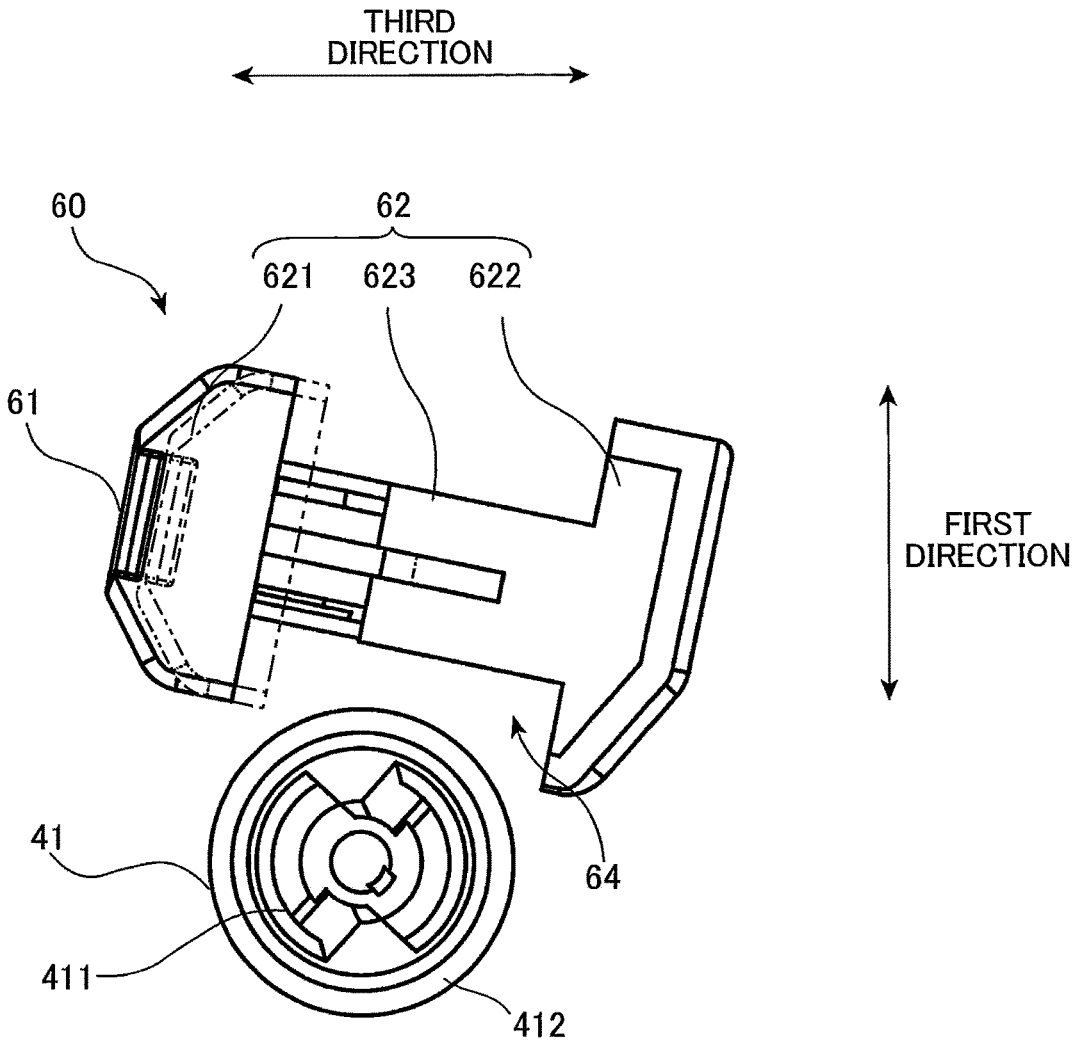
FIG. 6 is a view illustrating an initial position and a contracted position of a first holder of the chip holder.

FIG. 5A is a view illustrating the chip assembly 60 as viewed in the second direction. FIG. 5B is a view illustrating the chip assembly 60 as viewed in the first direction. FIG. 6 is a view illustrating an initial position and a contracted position of the first holder 621 of the chip holder 62 in a case where the chip holder 62 is at a first position.

The chip holder 62 includes a first holder 621, a second holder 622, and a connecting portion 623. The first holder 621 and the second holder 622 are arrayed with each other in the third direction. The connecting portion 623 extends in the third direction. The connecting portion 623 connects the first holder 621 to the second holder 622. That is, the first holder 621 and the second holder 622 are positioned away from each other in the third direction.

The first holder 621 has the outer surface 62A that retains the chip 61 (see FIG. 4). The connecting portion 623 includes a first connecting portion 623A extending in the third direction from the first holder 621 toward the second holder 622, and a second connecting portion 623B extending in the third direction from the second holder 622 toward the first holder 621. A combination of the first connecting portion 623A and the second connecting portion 623B constitute the connecting portion 623. The first holder 621 and the first connecting portion 623A may be integrally formed. The second holder 622 and the second connecting portion 623B may be integrally formed. Upon fitting engagement between the first connecting portion 623A and the second connecting portion 623B, the first connecting portion 623A is movable in the third direction along the second connecting portion 623B. Thus, the first holder 621 is movable relative to the second holder 622 in the third direction.

The connecting portion 623 has a uniform length in the first direction at all positions in the third direction. Here, the length in the first direction of the connecting portion 623 will be referred to as the "length L1". The first holder 621 has a portion facing the second holder 622 in the third direction, and the portion has a length L2 in the first direction. The second holder 622 has a portion facing the first holder 621 in the third direction, and the portion has a length L3 in the first direction. The length L1 is smaller than the length L2 and the length L3. Since the length L1 is smaller than the length L2 and the length L3, a space 64 (see FIG. 5A) is formed at a position around the connecting portion 623 and between the first holder 621 and the second holder 622.

The chip assembly 60 further includes a coil spring 63. The coil spring 63 is a resiliently deformable member configured to expand and contract in the third direction between a first state and a second state. In other words, the coil spring 63 is resiliently deformable in the third direction between the first state and the second state. The coil spring 63 is positioned between the first holder 621 and the second holder 622. The first holder 621 moves in the third direction relative to the second holder 622 in accordance with resilient deformation (specifically, expansion and contraction) of the coil spring 63. The connecting portion 623 has a hollow interior space extending in the third direction, in which the coil spring 63 is positioned.

The coil spring 63 in the first state has a length in the third direction greater than that of the coil spring 63 in the second state. In a case where the coil spring 63 has a natural length when the coil spring 63 is in the first state, the coil spring 63 in the second state has a length more contracted than the natural length. In the following description, a position of the first holder 621 in the third direction relative to the second holder 622 when the coil spring 63 is in the first state will be referred to as an "initial position" (an example of a third position and one position). Further, a position of the first holder 621 in the third direction relative to the second holder 622 when the coil spring 63 is in the second state will be referred to as a "contracted position" (an example of a fourth position and another position). The first holder 621 is positioned at the contracted position when the coil spring 63 is in the second state, and is positioned at the initial position when the coil spring 63 is in the first state. In other words, the first holder 621 is movable in the third direction relative to the second holder 622 between the initial position and the contracted position in accordance with expansion and contraction of the coil spring 63. Note that in FIG. 6, the position of the first holder 621 illustrated in solid lines is the initial position, and the position of the first holder 621 illustrated in dashed-two dotted lines is the contracted position.

The chip assembly 60 thus configured is held by the first cover 45 at the outer surface 11 of the casing 10. The first cover 45 has an opening 452 penetrating the thickness of the first cover 45 in the third direction. The chip assembly 60 is held by the first cover 45 by inserting the connecting portion 623 (the first connecting portion 623A and the second connecting portion 623B) into the opening 452.

The opening 452 of the first cover 45 has a length in the first direction smaller than the length L2 in the first direction of the first holder 621 and the length L3 in the first direction of the second holder 622. Therefore, the chip assembly 60 whose connecting portion 623 is inserted into the opening 452 does not fall out from the first cover 45.

Further, the length in the first direction of the opening 452 of the first cover 45 is greater than the length L1 in the first direction of the connecting portion 623. Therefore, the first holder 621 and the second holder 622 are movable in the first direction relative to the casing 10, the coupling 41, and the first cover 45.

During the process of attaching the developing cartridge 1 to the drawer unit 90, the first holder 621 moves toward the second holder 622. At this time, the second holder 622 abuts against a portion of the drawer unit 90. Hence, the drawer unit 90 prevents the second holder 622 from moving away from the first holder 621 in the third direction. The coil spring 63 contracts in accordance with the movement of the first holder 621. When the developing cartridge 1 is attached to the drawer unit 90, the first holder 621 moves away from the second holder 622 in the third direction due to a restoring force (resilience) of the coil spring 63 while the second holder 622 is in contact with the drawer unit 90. Thus, the electrical contact surface 611 is urged toward the corresponding electrical connector of the drawer unit 90, providing and maintaining electrical contact between the electrical contact surface 611 and the electrical connector.

Further, the image forming apparatus 100 has a contact state and a separation state. At the contact state, the developing roller 30 is in contact with the photosensitive drum, maintaining electrical contact between the electrical contact surface 611 and the corresponding electrical connector. At the separation state, the image forming apparatus 100 separates the developing roller 30 from the photosensitive drum. The image forming apparatus 100 is operated in one of the contact state and the separation state. In a case where the state of the image forming apparatus 100 changes between the contact state and the separation state, the casing 10, the coupling 41, and the first cover 45 move in the first direction while electrical contact between the electrical contact surface 611 and the corresponding electrical connector is maintained. Therefore, the casing 10, the coupling 41, and the first cover 45 move in the first direction relative to the chip holder 62 in a case where the state of the image forming apparatus 100 changes between the contact state and the separation state.

In the following description, a position of the chip holder 62 relative to the casing 10 and the first cover 45 when the image forming apparatus 100 is at the contact state will be referred to as a "first position", and a position of the chip holder 62 relative to the casing 10 and the first cover 45 when the image forming apparatus 100 is at the separation state will be referred to as a "second position". The second position is closer to the developing roller 30 than the first position is to the developing roller 30.

As described above, the first cover 45 has the through-hole 451 into which the coupling 41 is inserted. The opening 452 and the through-hole 451 are arrayed with each other in the first direction. That is, in a state where the chip assembly 60 and the coupling 41 are arrayed with each other in the first direction, the chip assembly 60 is attached to the first cover 45, and the fastening hole 411 of the coupling 41 is exposed to an outside through the through-hole 451 of the first cover 45.

Figure 7:
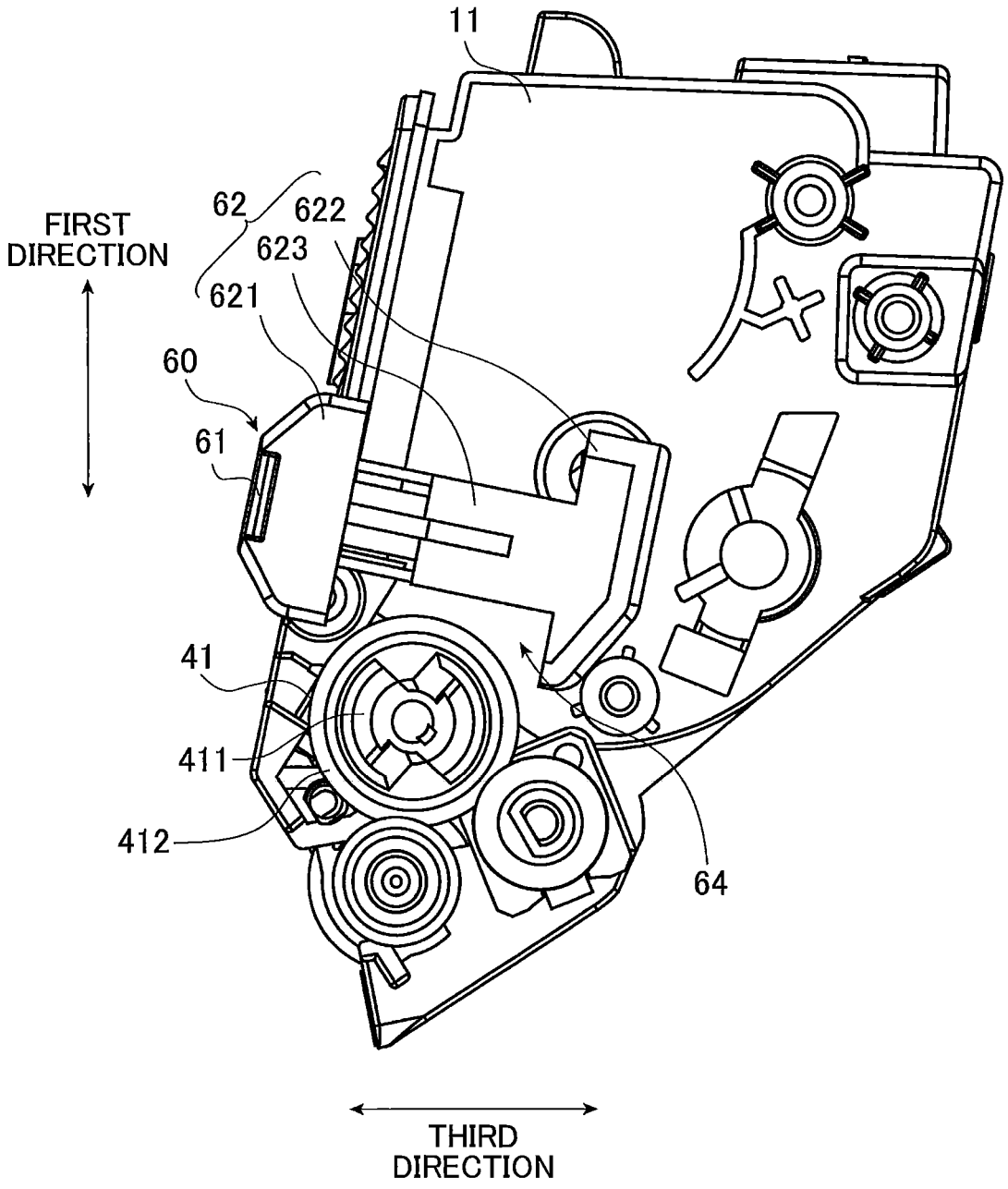
FIG. 7 is a view of an outer surface of the developing cartridge as viewed in the second direction.
Figure 8:
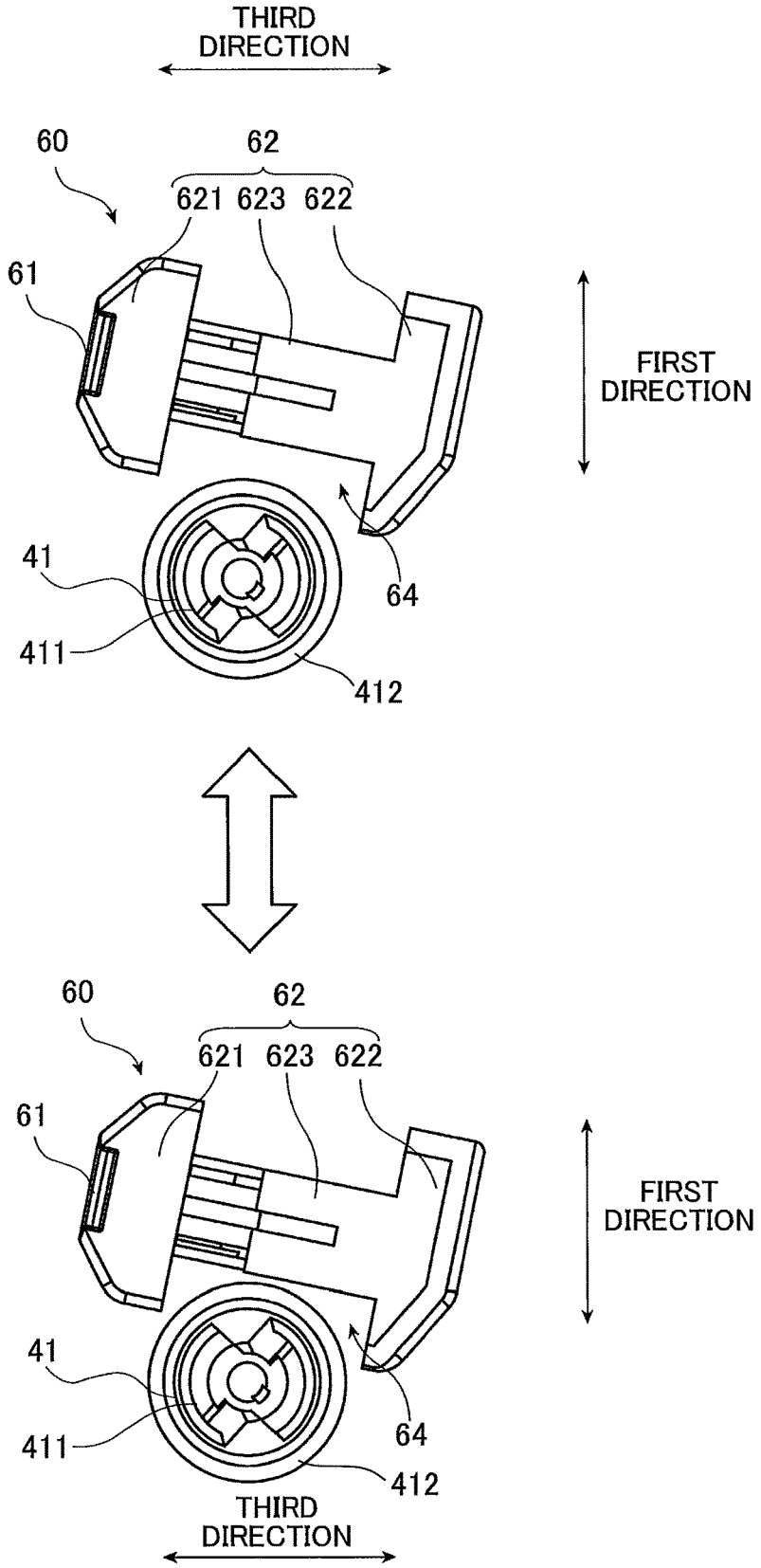
FIG. 8 is a view illustrating positional relationships between a chip holder and a coupling, in which an upper section illustrates a positional relationship between the chip holder at its first position and the coupling, and a lower section illustrates a positional relationship between the chip holder at its second position and the coupling.

FIG. 7 is a view of the outer surface 11 of the developing cartridge 1 as viewed in the second direction. In FIG. 7, the first cover 45 is not illustrated. Further, FIG. 7 illustrates the first position of the chip holder 62. FIG. 8 is a view illustrating positional relationships between the chip holder 62 and the coupling 41, in which an upper view illustrates a positional relationship between the chip holder 62 and the coupling 41 when the chip holder 62 is at the first position while a lower view illustrates a positional relationship between the chip holder 62 and the coupling 41 when the chip holder 62 is at the second position. Note that, in FIG. 8, the first holder 621 is positioned at the initial position.

As illustrated in FIG. 7, the chip assembly 60 and the coupling 41 are arrayed with each other in the first direction. A portion of the coupling 41 is positioned between the first holder 621 and the second holder 622 in the third direction, and is positioned away from the connecting portion 623 in the first direction. That is, the portion of the coupling 41 is positioned in the space 64 between the first holder 621 and the second holder 622. With this structure, the coupling 41 is positioned between the first holder 621 and the second holder 622 in the third direction, and the first holder 621 and the second holder 622 partly overlap with the coupling 41 in the first direction. Accordingly, the first holder 621 and the second holder 622, and the coupling 41 can be positioned closer to each other in the first direction. As a result, the developing cartridge 1 can be made compact to thus realize the compact image forming apparatus 100 to which the developing cartridge 1 is attached.

Incidentally, the portion of the coupling 41 can be positioned in the space 64 in spite of the contracted position of the first holder 621 (see FIG. 6). That is, a gap length in the third direction between the first holder 621 at the contracted position and the second holder 622 is greater than a length in the third direction of the portion of the coupling 41 positioned in the space 64. Accordingly, interference between the coupling 41, and the first holder 621 and the second holder 622 does not occur in spite of the structure where the coupling 41 is entered into the space 64 of the chip assembly 60 in the first direction as seen in FIG. 7.

Further, as illustrated in the lower view of FIG. 8, in a case where the chip holder 62 is at the second position, the portion of the coupling 41 is positioned between the first holder 621 and the second holder 622 in the third direction, and, in this state, the portion of the coupling 41 is positioned away from the connecting portion 623 in the first direction. That is, the portion of the coupling 41 is positioned in the space 64 between the first holder 621 and the second holder 622.

In other words, regardless of the first position and the second position of the chip holder 62, the coupling 41 is positioned between the first holder 621 and the second holder 622 in the third direction, and the first holder 621 and the second holder 622 partly overlap with the coupling 41 in the first direction. Accordingly, the first holder 621 and the second holder 622, and the coupling 41 can be positioned closer to each other in the first direction. As a result, the developing cartridge 1 can be made compact.

Incidentally, the portion of the coupling 41 may be positioned in the space 64 between the first holder 621 and the second holder 622 only when the chip holder 62 is at the second position. The portion of the coupling 41 may not be positioned in the space 64 between the first holder 621 and the second holder 622 when the image forming apparatus 100 is at the contact position in which the chip holder 62 is at the first position. Even in this case, the coupling 41 is positioned between the first holder 621 and the second holder 622 in the third direction, and the first holder 621 and the second holder 622 partly overlap with the coupling 41 in the first direction at least when the image forming apparatus 100 is at the separation state in which the chip holder 62 is at the second position. Accordingly, the first holder 621 and the second holder 622, and the coupling 41 can be positioned closer to each other in the first direction.

2. Second Embodiment

Next, a developing cartridge 2 according to a second embodiment will be described with reference to FIGS. 9 through 11, wherein like parts and components with those of the developing cartridge 1 according to the first embodiment are designated with the same reference numerals to avoid duplicating description.

A structure for reducing a dimension in the first direction of the developing cartridge 2 according to the second embodiment is different from that of the developing cartridge 1 according to the first embodiment. Specifically, the chip holder 62 according to the first embodiment has the space 64 as illustrated in FIG. 5A, whereas a chip holder 65 according to the second embodiment does not have the space 64. Further, the coupling 41 according to the first embodiment is positioned at the outer surface 11 of the developing cartridge 1 and is integral with the coupling gear 412. On the other hand, a coupling 141 according to the second embodiment is formed separately from the coupling gear 412 and is positioned away from the outer surface 11 in the second direction. Further, the chip holder 65 is positioned between the coupling 141 and the coupling gear 412 in the second direction.

Figure 9:
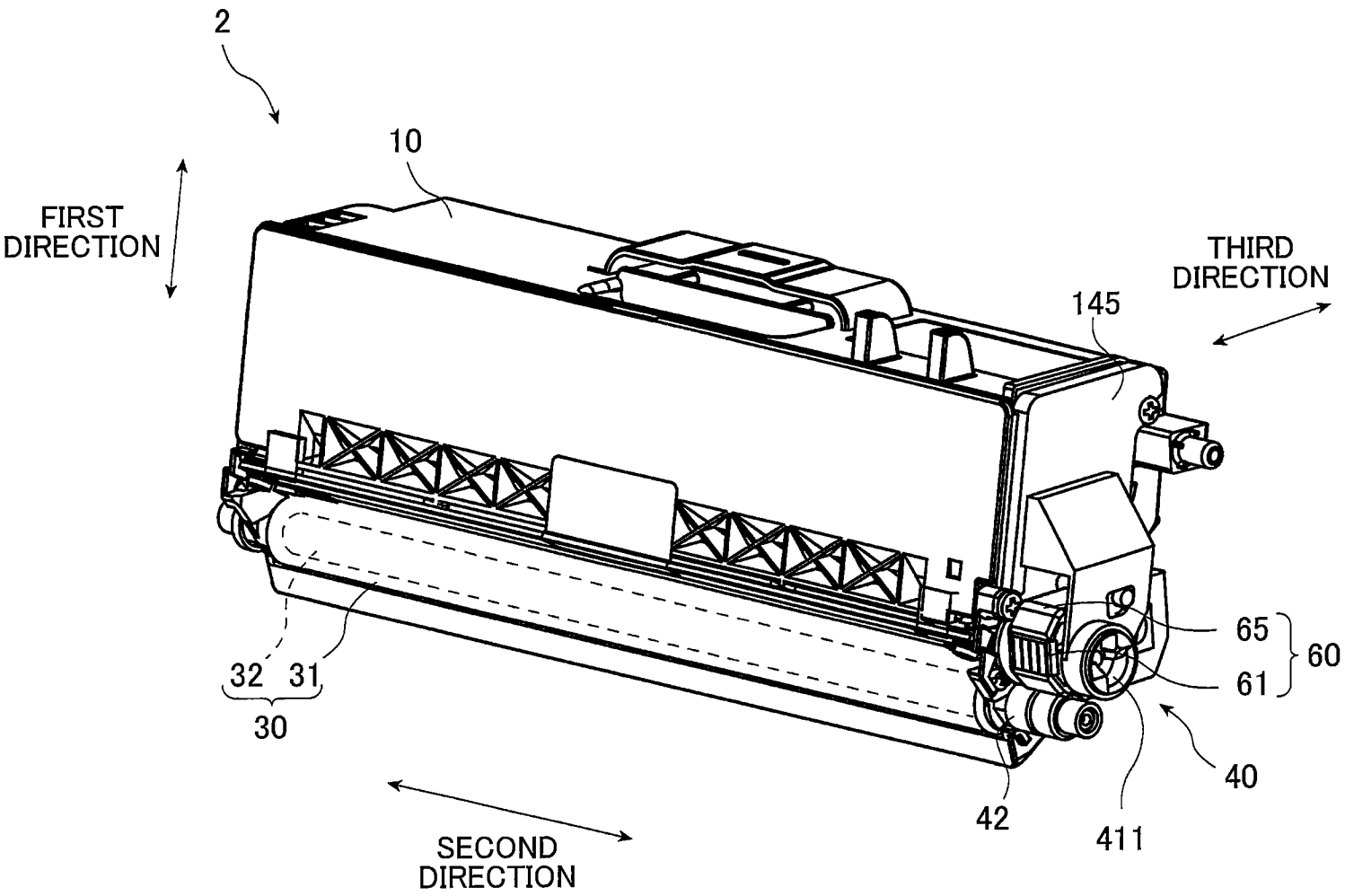
FIG. 9 is a perspective view of a developing cartridge according to a second embodiment.

FIG. 9 is a perspective view of the developing cartridge 2 according to the second embodiment. FIG. 10 is an exploded perspective view of the developing cartridge 2.

Figure 10:
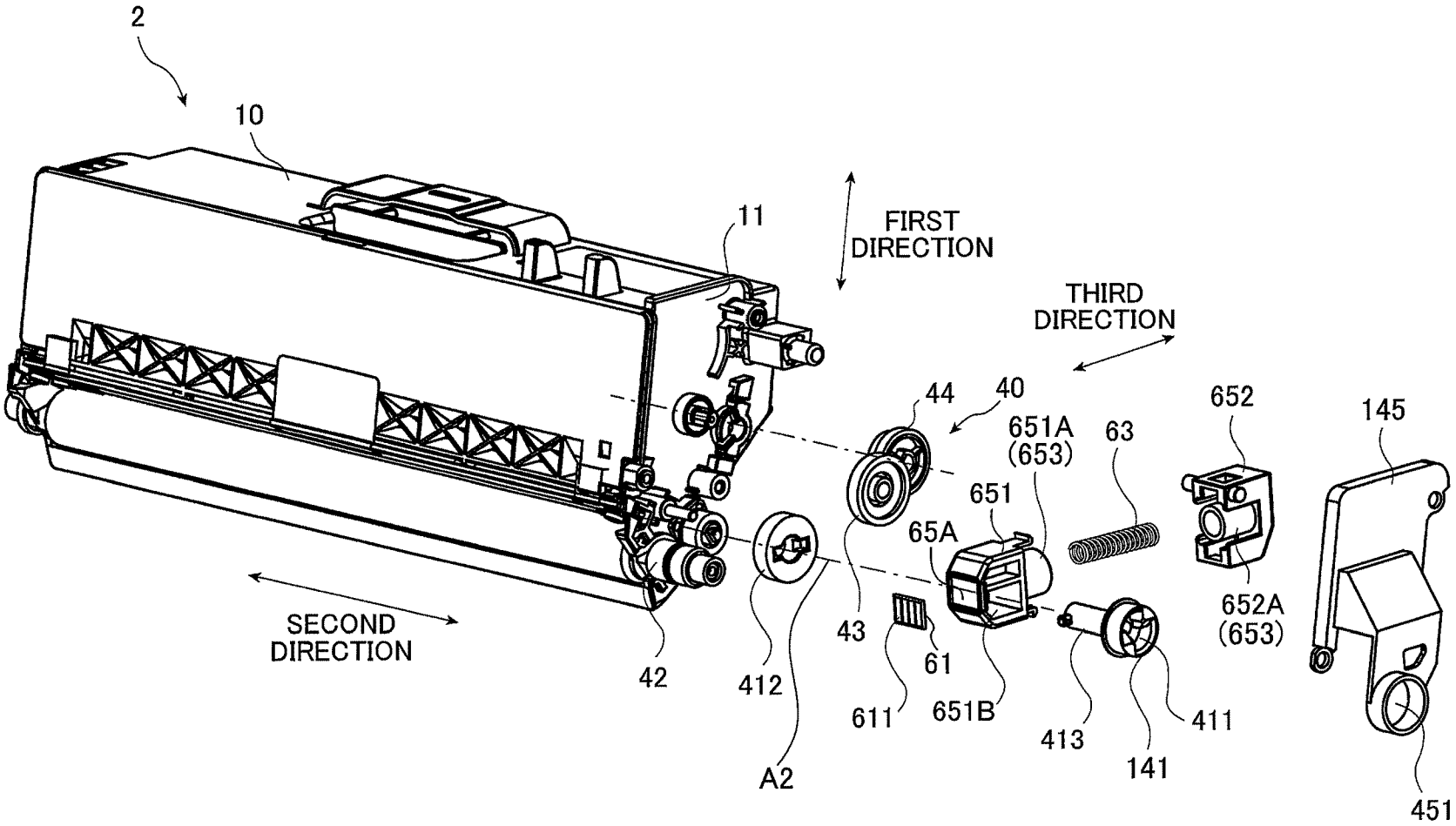
FIG. 10 is an exploded perspective view of the developing cartridge according to the second embodiment.

As illustrated in FIG. 10, the coupling 141 is positioned away from the outer surface 11 in the second direction. The coupling gear 412 is rotatably supported to the outer surface 11. That is, the coupling gear 412 is rotatable relative to the outer surface 11. The coupling 141 is positioned away from the coupling gear 412 in the second direction.

The developing cartridge 2 further includes a shaft 413 extending in the second direction from the coupling 141 to the coupling gear 412 The shaft 413 connects the coupling 141 and the coupling gear 412 to each other. The coupling gear 412 rotates together with the coupling 141 through the shaft 413. The coupling 141 is rotatable about a second axis A2 extending in the second direction. The coupling 141, the coupling gear 412, and the shaft 413 may be formed as separate members or may be integrally formed. In the present embodiment, the coupling 141 and the shaft 413 are integrally formed.

The shaft 413 has a columnar shape. The shaft 413 has an outer diameter that is smaller than an outer diameter of the coupling 141 and an outer diameter of the coupling gear 412. Incidentally, the outer diameter of the coupling gear 412 may be a diameter excluding the gear teeth (i.e. a diameter of a dedendum or root circle of the coupling gear 412) or a diameter including the gear teeth (i.e. a diameter of an addendum circle of the coupling gear 412), as long as a space is formed around the shaft 413 and between the coupling 141 and the coupling gear 412.

The chip assembly 60 includes a chip holder 65. The chip holder 65 is movable between the first position and the second position, similar to the chip holder 62 movable between the first position and the second position according to the first embodiment. The chip holder 65 includes a first holder 651, a second holder 652, and a connecting portion 653. Through the connecting portion 653, the first holder 651 and the second holder 652 are assembled together so as to be incapable of detaching from each other. That is, the first holder 651 and the second holder 652 are positioned away from each other in the third direction. The first holder 651 and the second holder 652 are movable in the first direction and the third direction relative to the casing 10 and the coupling 141. Further, the first holder 651 is movable in the third direction relative to the second holder 652.

The first holder 651 has the outer surface 65A that retains the chip 61. The connecting portion 653 includes a first connecting portion 651A having a hollow cylindrical shape extending in the third direction from the first holder 651 toward the second holder 652, and a second connecting portion 652A having a hollow cylindrical shape extending in the third direction from the second holder 652 toward the first holder 651. The first holder 651 and the first connecting portion 651A may be integrally formed. The second holder 652 and the second connecting portion 652A may be integrally formed. The first connecting portion 651A has an inner diameter greater than an outer diameter of the second connecting portion 652A, so that the second connecting portion 652A can be inserted into the first connecting portion 651A. An inner diameter of the second connecting portion 652A is greater than an outer diameter of the coil spring 63, so that the coil spring 63 can be accommodated inside the first connecting portion 651A and the second connecting portion 652A. The coil spring 63 is accommodated inside the connecting portion 651A and the second connecting portion 652A with a contracted state of the coil spring 63 whose length is shorter than the natural length thereof. The first holder 651 compresses the coil spring 63 when the first holder 651 moves toward the second holder 652 in the third direction. Further, the first holder 651 is movable in the third direction away from the second holder 652 by the restoring force of the coil spring 63. Thus, the first holder 651 is positioned at the contracted position (an example of a fourth position and another position) when the coil spring 63 is in the second state, and is positioned at the initial position (an example of a third position and one position) when the coil spring 63 is in the first state. In other words, the first holder 651 is movable in the third direction relative to the second holder 652 between the initial position and the contracted position in accordance with resilient deformation (specifically, expansion and contraction) of the coil spring 63.

The first holder 651 has a through-hole 651B penetrating the thickness of the first holder 651 in the second direction. The shaft 413 is inserted into the through-hole 651B. Here, a gap length between the coupling 141 and the coupling gear 412 in the second direction is greater than a length of the first holder 651 in the second direction. The first holder 651 is positioned between the coupling 141 and the coupling gear 412. That is, the coupling 141 and the coupling gear 412 are held in the first holder 651 in a state where the shaft 413 is inserted into the through-hole 651B. The chip holder 65 is positioned and held between a first cover 145 and the outer surface 11 in a state where the shaft 413 is inserted into the through-hole 451 of the first cover 145.

The through-hole 651B of the first holder 651 has an inner dimension in the first direction that is greater than the outer diameter of the shaft 413 and smaller than the outer diameter of the coupling 141 and the outer diameter of the coupling gear 412. The through-hole 651B also has an inner dimension in the third direction that is greater than the outer diameter of the shaft 413 and smaller than the outer diameter of the coupling 141 and the outer diameter of the coupling gear 412. Therefore, the first holder 651 is movable in the first direction and the third direction relative to the coupling 141 and the coupling gear 412. Accordingly, the first holder 651 is movable in the third direction relative to the second holder 652 in accordance with resilient deformation (specifically, expansion and contraction) of the coil spring 63. Further, the image forming apparatus 100 can be operated in one of the contact state where the developing roller 30 is in contact with the photosensitive drum and the separation state where the developing roller 30 is separated from the photosensitive drum.

Figure 11:
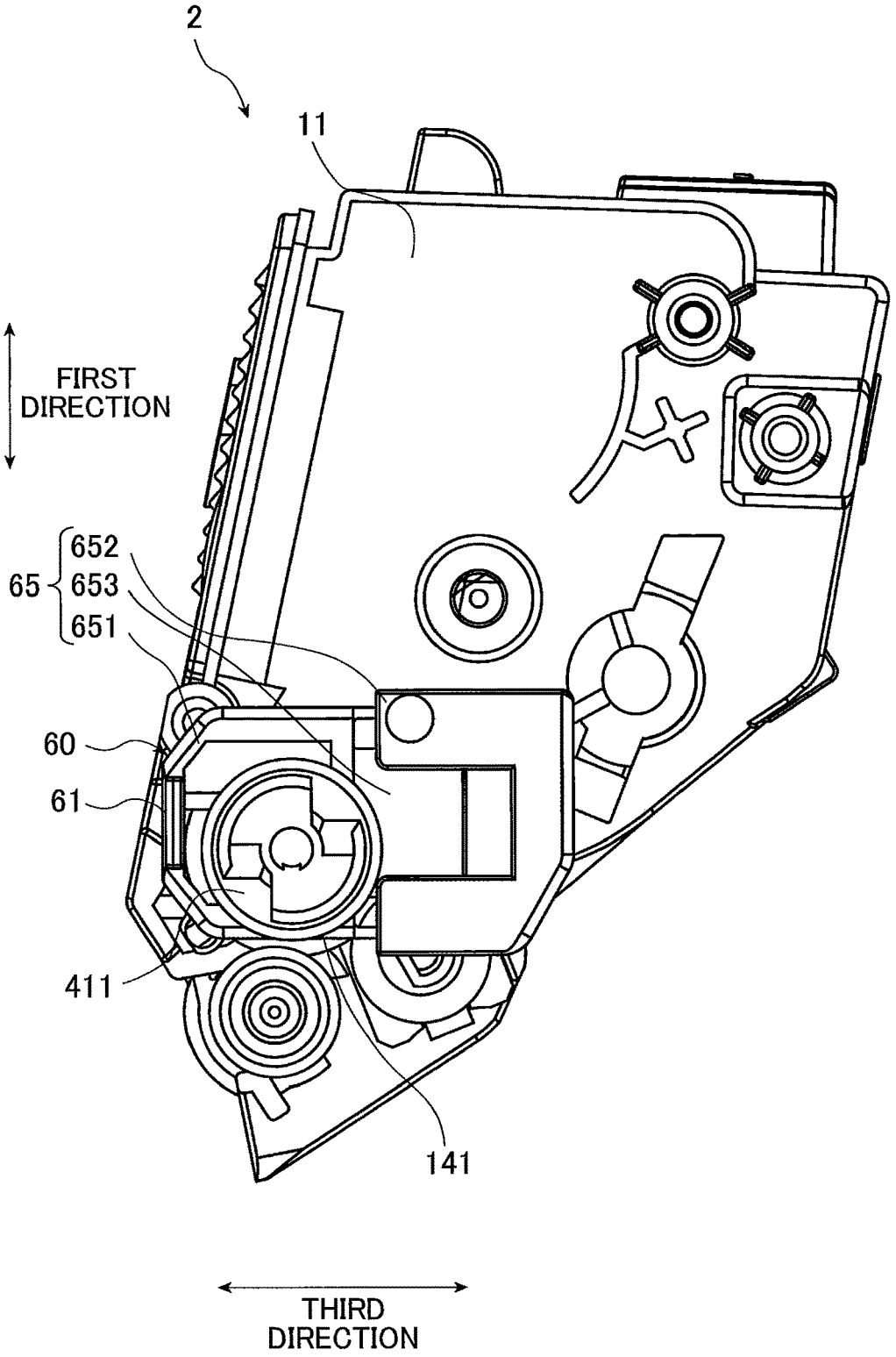
FIG. 11 is a view of an outer surface of the developing cartridge according to the second embodiment as viewed in the second direction.

FIG. 11 is a view of the outer surface 11 of the developing cartridge 2 as viewed in the second direction. In FIG. 11, the first cover 145 is not illustrated.

As illustrated in FIG. 11, the chip assembly 60 and the coupling 141 are arrayed with each other in the first direction. Further, a portion of the coupling 141 is positioned between the first holder 651 and the second holder 652 in the third direction as the shaft 413 is inserted into the through-hole 651B of the first holder 651. Since the shaft 413 is inserted into the through-hole 651B of the first holder 651, the portion of the coupling 141 is positioned between the first holder 651 and the second holder 652 in the third direction regardless of the first position and the second position of the chip holder 65.

The portion of the coupling 141 is positioned between the first holder 651 and the second holder 652 in the third direction, and the first holder 651 and the second holder 652 overlap with the coupling 141 in the first direction and the third direction. In other words, the first holder 651 and the second holder 652, and the coupling 141 are positioned close to each other in the first direction and the third direction. Further, the shaft 413 connected to the coupling 141 is inserted into the through-hole 651B of the first holder 651. The first holder 651 and the second holder 652, and the coupling 141 are thus positioned close to each other in the second direction. As a result, the developing cartridge 2 can be made compact.

3. Third Embodiment

Next, a developing cartridge according to a third embodiment will be described with reference to FIGS. 12 and 13, wherein like parts and components with those of the developing cartridge 1 according to the first embodiment and the developing cartridge 2 according to the second embodiment are designated with the same reference numerals to avoid duplicating description.

The third embodiment is similar to the second embodiment in that a first holder 1651 has a through-hole 1651C penetrating the thickness thereof in the second direction, and a coupling 241 is inserted into the through-hole 1651C. However, the third embodiment is different from the second embodiment in that in the second embodiment the portion of the coupling 141 is positioned between the first holder 651 and the second holder 652, whereas in the third embodiment a portion of the coupling 241 is positioned inside the first holder 1651.

Figure 12:
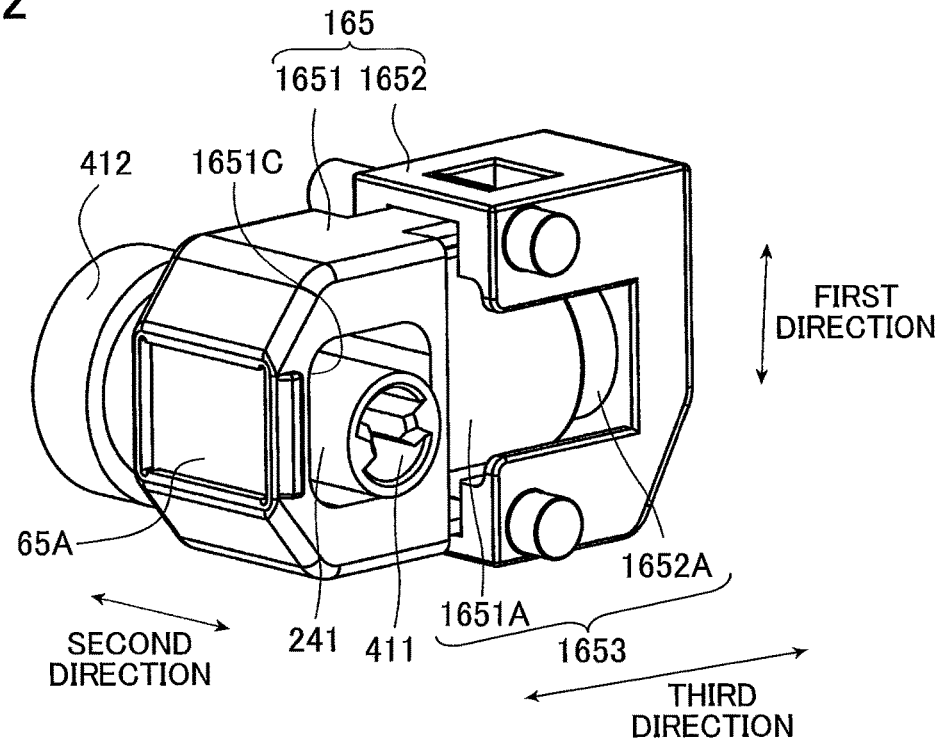
FIG. 12 a perspective view of a chip holder and a coupling of a developing cartridge according to a third embodiment.
Figure 13:
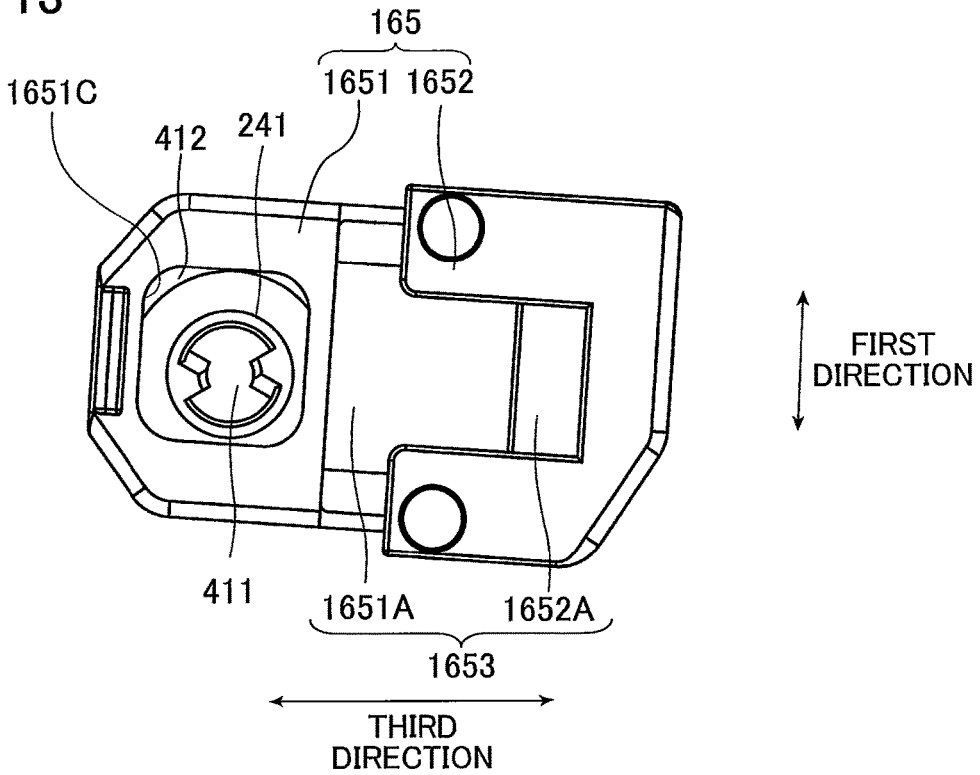
FIG. 13 is a view of the chip holder and the coupling of FIG. 12 as viewed in the second direction.

FIG. 12 is a perspective view of a chip holder 165 and the coupling 241 of the developing cartridge according to the third embodiment. FIG. 13 is a view of the chip holder 165 and the coupling 241 illustrated in FIG. 12 as viewed in the second direction.

The coupling 241 has a hollow cylindrical shape extending in the second direction. The coupling 241 has one end portion in the second direction formed with the fastening hole 411 (recessed portion) that is recessed in the second direction, and has the other end portion in the second direction to which the coupling gear 412 is connected. Thus, the coupling 241 and the coupling gear 412 rotate together about a second axis extending in the second direction. The coupling 241 and the coupling gear 412 may be formed as separate members or may be integrally formed with each other.

The chip assembly 60 includes the chip holder 165. Similar to the chip holder 65 according to the second embodiment, the chip holder 165 includes the first holder 1651, a second holder 1652, and a connecting portion 1653. The first holder 1651 is movable in the third direction relative to the second holder 1652. Further, the connecting portion 1653 includes a first connecting portion 1651A having a hollow cylindrical shape extending in the third direction from the first holder 1651 toward the second holder 1652, and a second connecting portion 1652A having a hollow cylindrical shape extending in the third direction from the second holder 1652 toward the first holder 1651. The first holder 1651 and the first connecting portion 1651A may be integrally formed. The second holder 1652 and the second connecting portion 1652A may be integrally formed. The first connecting portion 1651A and the second connecting portion 1652A are arrayed with each other in the third direction. That is, the first holder 1651 and the second holder 1652 are positioned away from each other in the third direction. The coil spring 63 is accommodated inside the first connecting portion 1651A and the second connecting portion 1652A. The first holder 1651 is movable in the third direction relative to the second holder 1652 in accordance with resilient deformation (specifically, expansion and contraction) of the coil spring 63.

The first holder 1651 has the through-hole 1651C penetrating the thickness of the first holder 1651 in the second direction. The coupling 241 is inserted into the through-hole 1651C. The through-hole 1651C has an inner dimension in the first direction that is greater than an outer diameter of the coupling 241. The through-hole 1651C also has an inner dimension in the third direction that is greater than the outer diameter of the coupling 241. Therefore, the first holder 1651 and the second holder 1652 are movable in the first direction and the third direction relative to the casing 10 and the coupling 241 in a state where the coupling 241 is inserted into the through-hole 1651C. That is, the first holder 1651 and the second holder 1652 are movable between the first position and the second position in a state where the coupling 241 is inserted into the through-hole 1651C. Further, the first holder 1651 is movable in the third direction relative to the second holder 1652 between the initial position (an example of a third position and one position) and the contracted position (an example of a fourth position and another position) in accordance with resilient deformation (specifically, expansion and contraction) of the coil spring 63.

In this way, the first holder 1651 and the second holder 1652 overlap with the coupling 241 in the first direction. That is, the first holder 1651 and the second holder 1652, and the coupling 241 are positioned close to each other in the first direction. As a result, the developing cartridge according to the third embodiment can be made compact in the first direction. In addition, since the coupling 241 is inserted into the through-hole 1651C of the first holder 1651, the developing cartridge according to the third embodiment can also be made small in the second direction and the third direction.

<4. Modifications>

While the description has been made in detail with reference to the embodiments thereof, it would be apparent to those skilled in the art that many modifications and variations may be made therein without departing from the scope of the disclosure.

For example, the structure for making the developing cartridge small in the first direction is not limited to the above examples.

<4.1. First Modification>

Next, a first modification will be described with reference to FIGS. 14 and 15, wherein like parts and components are designated by the same reference numerals as those of the third embodiment to avoid duplicating description. The first modification is one modification to the third embodiment.

According to the third embodiment, the first holder 1651 has the through-hole 1651C through which the coupling 241 is inserted. However, a second holder 1652 may have a through-hole. As the first modification, a structure where a through-hole 2652B is formed in a second holder 2652 for inserting the coupling 241 will be described.

Figure 14:
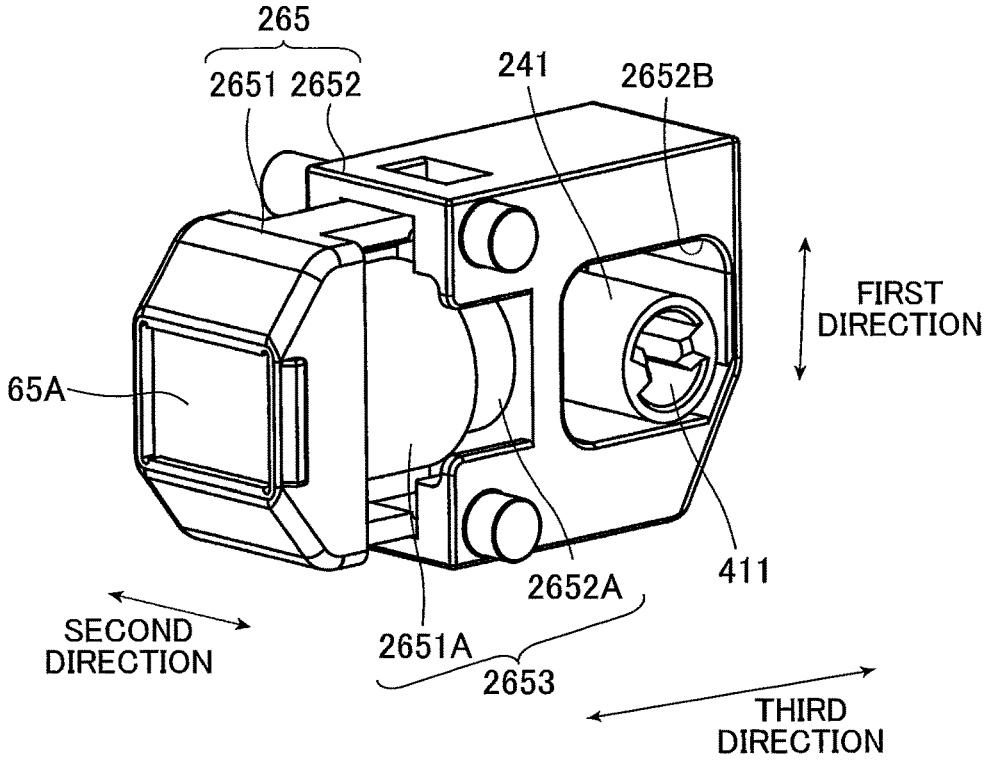
FIG. 14 a perspective view of a chip holder and a coupling of a developing cartridge according to a first modification, in a case where the coupling is positioned inside a second holder.

FIG. 14 is a perspective view of a chip holder 265 and a coupling 241 in a case where the coupling 241 is positioned inside the second holder 2652. FIG. 15 is a view of the chip holder 265 and the coupling 241 illustrated in FIG. 14 as viewed in the second direction.

According to the first modification, the chip holder 265 includes a first holder 2651, a second holder 2652, and a connecting portion 2653. The connecting portion 2653 includes a first connecting portion 2651A having a hollow cylindrical shape extending in the third direction from the first holder 2651 toward the second holder 2652, and a second connecting portion 2652A having a hollow cylindrical shape extending in the third direction from the second holder 2652 toward the first holder 2651. That is, the first holder 2651 and the second holder 2652 are positioned away from each other in the third direction. The first connecting portion 2651A may be integral with the first holder 2651, and the second connecting portion 2652A may be integral with the second holder 2652. The second holder 2652 has the through-hole 2652B penetrating the thickness of the second holder 2652 in the second direction. The coupling 241 is inserted into the through-hole 2652B. The through-hole 2652B has an inner dimension in the first direction that is greater than the outer diameter of the coupling 241. The through-hole 2652B also has an inner dimension in the third direction that is greater than the outer diameter of the coupling 241. Therefore, similar to the third embodiment illustrated in FIGS. 12 and 13, the first holder 2651 and the second holder 2652 are movable relative to the casing 10 and the coupling 241 in the first direction and the third direction in a state where the coupling 241 is inserted into the through-hole 2652B. That is, the first holder 2651 and the second holder 2652 are movable between the first position and the second position in a state where the coupling 241 is inserted into the through-hole 2652B. Further, the first holder 2651 is movable in the third direction relative to the second holder 2652 between the initial position (an example of a third position and one position) and the contracted position (an example of a fourth position and another position) in accordance with resilient deformation (specifically, expansion and contraction) of the coil spring 63.

The first holder 2651 and the second holder 2652 overlap with the coupling 241 in the first direction. That is, the first holder 2651 and the second holder 2652, and the coupling 241 are positioned close to each other in the first direction. Thus, the developing cartridge according to the first modification can be made compact in the first direction. In addition, since the coupling 241 is inserted into the through-hole 2652B of the second holder 2652, the developing cartridge according to this modification can also be made small in the second direction and the third direction.

<4.2. Second Modification>

The first holder 1651 (2651) and the second holder 1652 (2652) are not limited to the structures according to the third embodiment and the first modification.

A second modification will be described with reference to FIGS. 16 and 17, wherein like parts and components are designated by the same reference numerals as those of the third embodiment to avoid duplicating description. The second modification is another modification to the third embodiment.

Figure 16:
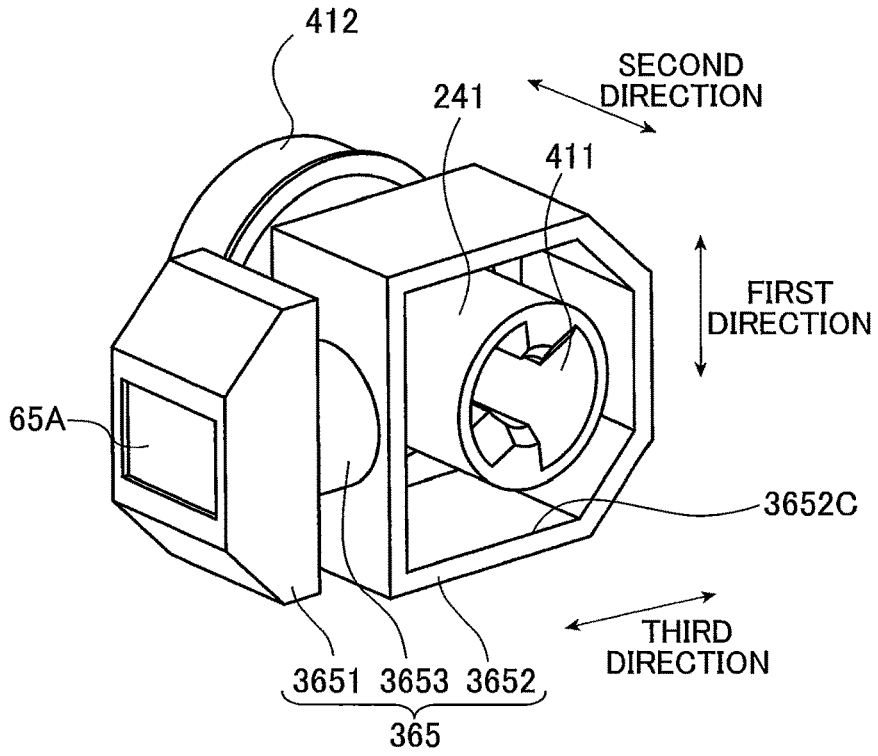
FIG. 16 is a perspective view of a chip holder and a coupling of a developing cartridge according to a second modification.

FIG. 16 is a perspective view of a chip holder 365 and the coupling 241 according to the second modification. FIG. 17 is a view of the chip holder 365 and the coupling 241 illustrated in FIG. 16 as viewed in the second direction.

Figure 15:
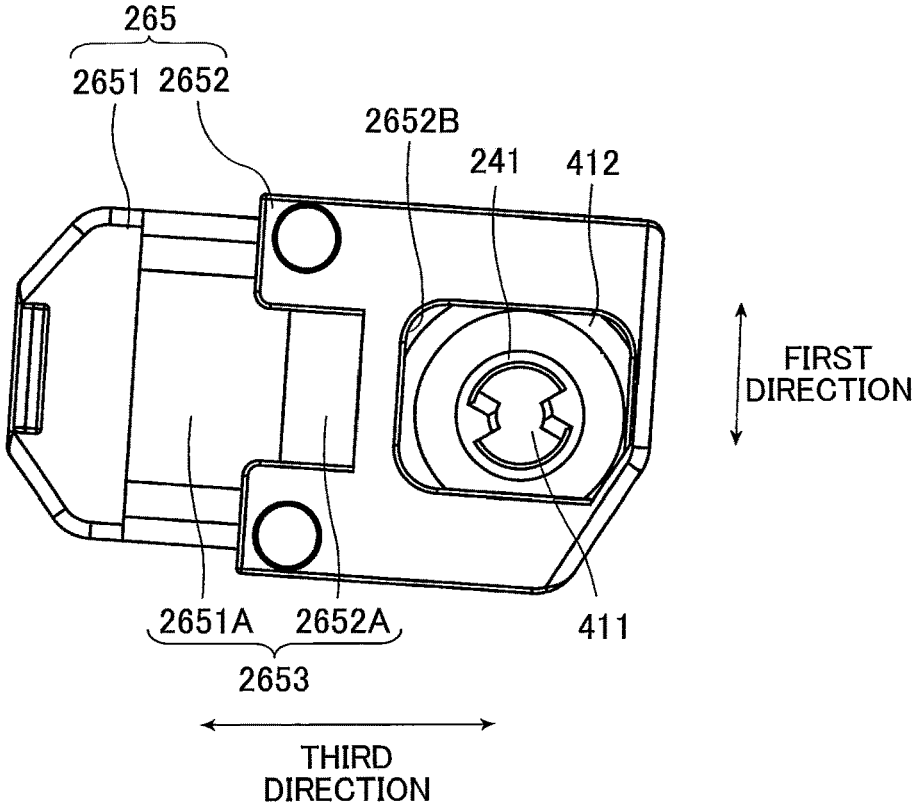
FIG. 15 is a view of the chip holder and the coupling of FIG. 14 as viewed in the second direction.
Figure 17:
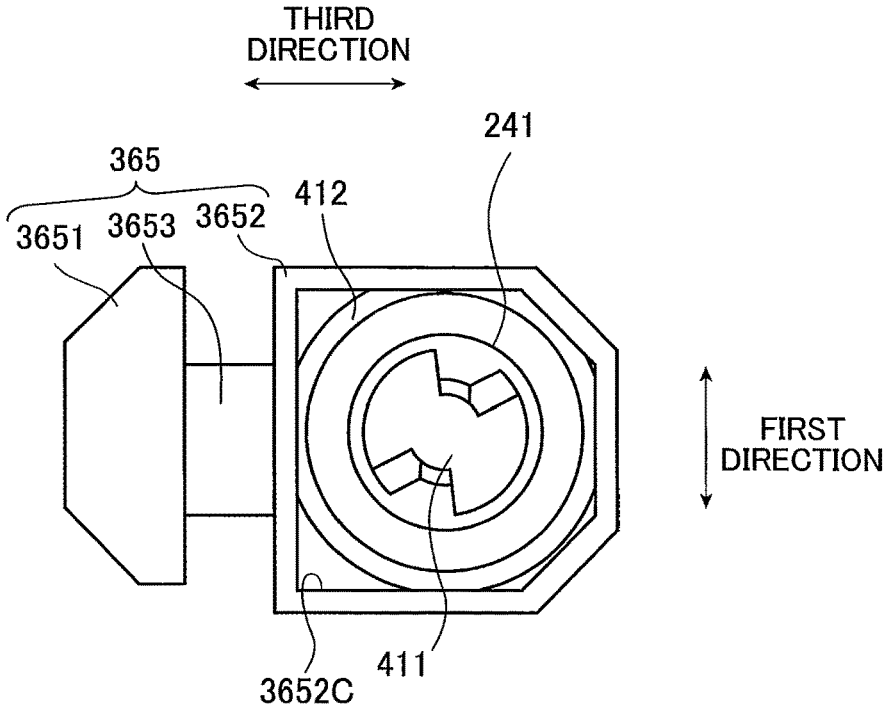
FIG. 17 is a view of the chip holder and the coupling of FIG. 16 as viewed in the second direction.

Similar to the chip holder 265 according to the first modification illustrated in FIGS. 14 and 15, in the chip holder 365 according to the second modification illustrated in FIGS. 16 and 17, the second holder 3652 has a through-hole 3652C penetrating the thickness of the second holder 3652 in the second direction.

The chip holder 365 includes a first holder 3651, the second holder 3652, and a connecting portion 3653. The first holder 3651 and the second holder 3652 are positioned away from each other in the third direction. The coil spring 63 is accommodated inside the connecting portion 3653.

The through-hole 3652C has an inner dimension in the first direction that is greater than the outer diameter of the coupling 241. The through-hole 3652C also has an inner dimension in the third direction that is greater than the outer diameter of the coupling 241. The coupling 241 is inserted in the through-hole 3652C. Therefore, the first holder 3651 and the second holder 3652 are movable relative to the casing 10 and the coupling 241 in the first direction and the third direction in a state where the coupling 241 is inserted into the through-hole 3652C. The first holder 3651 and the second holder 3652 are movable between the first position and the second position in a state where the coupling 241 is inserted into the through-hole 3652C.

The first holder 3651 and the second holder 3652 overlap with the coupling 241 in the first direction. In other words, the first holder 3651 and the second holder 3652, and the coupling 241 are positioned close to each other in the first direction. Thus, the developing cartridge according to the first modification can be made compact in the first direction. In addition, since the coupling 241 is inserted into the through-hole 3652C of the second holder 3652, the developing cartridge according to this modification can also be made small in the second direction and the third direction.

<4.3. Third Modification>

Figure 18:
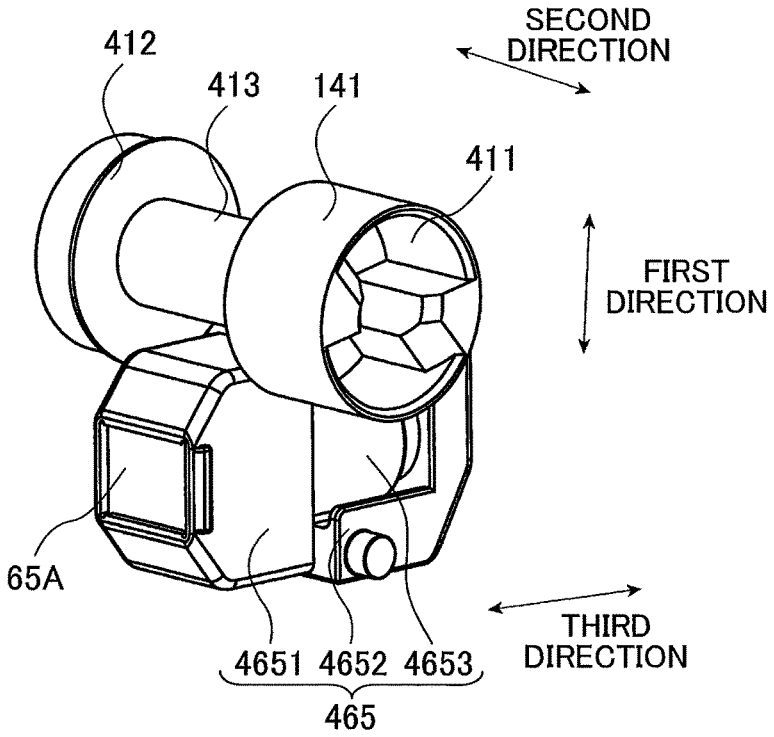
FIG. 18 illustrates a positional relationship between a chip holder and a coupling of a developing cartridge according to a third modification.
Figure 19:
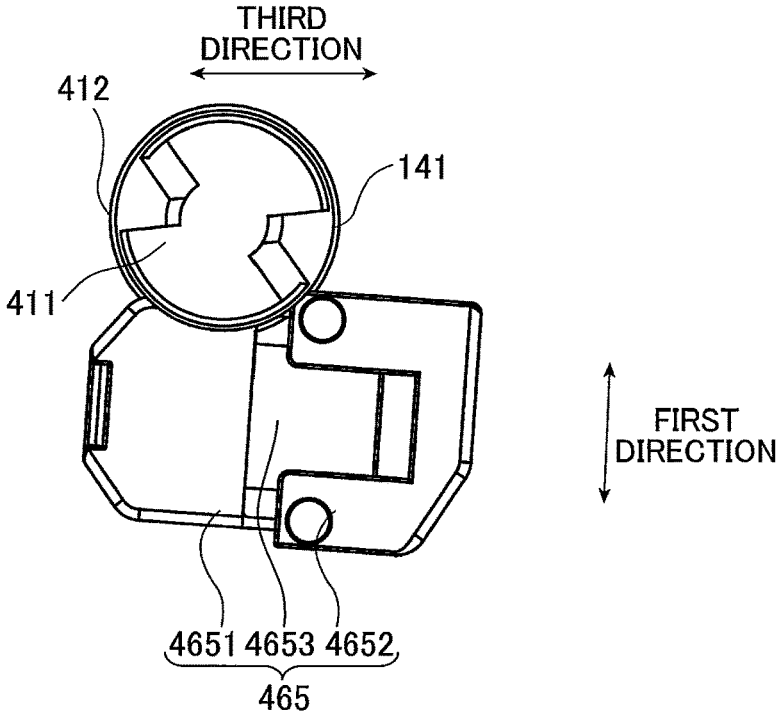
FIG. 19 a view of the chip holder and the coupling of FIG. 18 as viewed in the second direction.

A third modification will be described with reference to FIGS. 18 and 19, wherein like parts and components are designated by the same reference numerals as those of the second embodiment to avoid duplicating description. The third modification is one modification to the second embodiment. FIGS. 18 and 19 illustrate a structure for making a developing cartridge according to the third modification small in the first direction. FIG. 18 is a perspective view of a chip holder 465 and the coupling 141 according to the third modification. FIG. 19 is a view of the chip holder 465 and the coupling 141 illustrated in FIG. 18 as viewed in the second direction. In FIGS. 18 and 19, components of the developing cartridge according to the third modification other than the chip holder 465 and the coupling 141 are not illustrated.

Similar to the chip holder 65 according to the second embodiment, the chip holder 465 according to the third modification includes a first holder 4651, a second holder 4652, and a connecting portion 4653. However, the first holder 4651 according to the third modification does not have the through-hole 651B in the second embodiment illustrated in FIG. 10. The first holder 4651 and the second holder 4652 are positioned away from each other in the third direction. The coil spring 63 is accommodated inside the connecting portion 4653. The first holder 4651 and the second holder 4652 are movable in the first direction and the third direction relative to the casing 10 and the coupling 141. Further, the first holder 4651 is movable in the third direction relative to the second holder 4652 between the initial position (an example of a third position and one position) and the contracted position (an example of a fourth position and another position) in accordance with resilient deformation (specifically, expansion and contraction) of the coil spring 63.

The coupling 141 according to the third modification is connected to the coupling gear 412 through the shaft 413 extending in the second direction from the coupling 141 to the coupling gear 412, similar to the second embodiment. That is, the coupling 141 and the coupling gear 412 are connected to each other through the shaft 413. A gap length between the coupling 141 and the coupling gear 412 in the second direction is greater than a length of the chip holder 465 in the second direction. The chip holder 465 is positioned between the coupling 141 and the coupling gear 412. Further, regardless of the first position and the second position of the chip holder 465, a portion of the coupling 141 is positioned between the first holder 4651 and the second holder 4652 in the third direction.

With this structure, the portion of the coupling 141 is positioned between the first holder 4651 and the second holder 4652 in the third direction, and the first holder 4651 and the second holder 4652 partly overlap with the coupling 141 in the first direction, so that the first holder 4651 and the second holder 4652, and the coupling 141 can be positioned closer to each other in the first direction. Accordingly, the developing cartridge according to this modification can be made compact.

<4.4. Fourth Modification>

Further, in order to reduce the size of the developing cartridge in the first direction, the chip holder 62 according to the first embodiment may be combined with the coupling 141 and the shaft 413 according to the second embodiment.

A fourth modification will be described with reference to FIGS. 20 and 21, wherein like parts and components are designated by the same reference numerals as those of the above-described embodiments 1 and 2 to avoid duplicating description.

Figure 20:
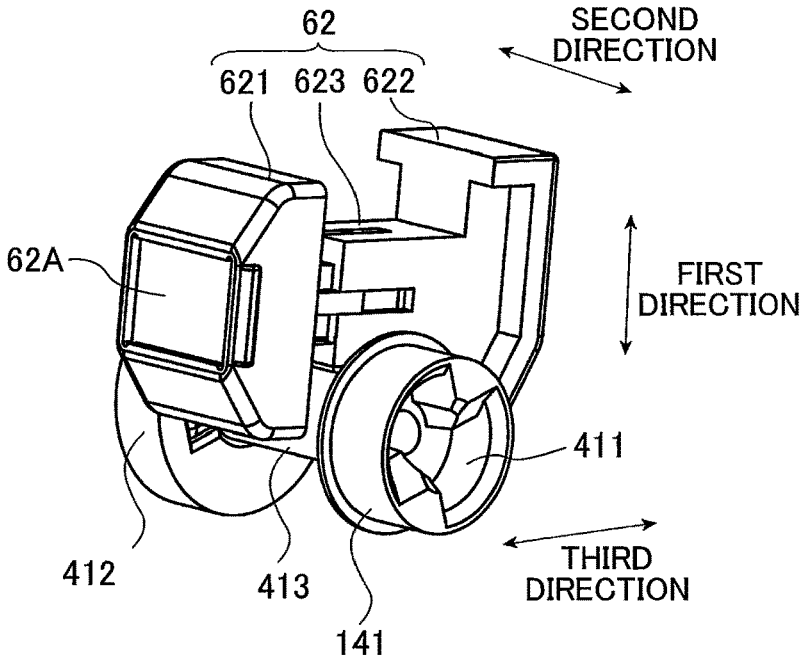
FIG. 20 illustrates a positional relationship between a chip holder and a coupling of a developing cartridge according to a fourth modification.
Figure 21:
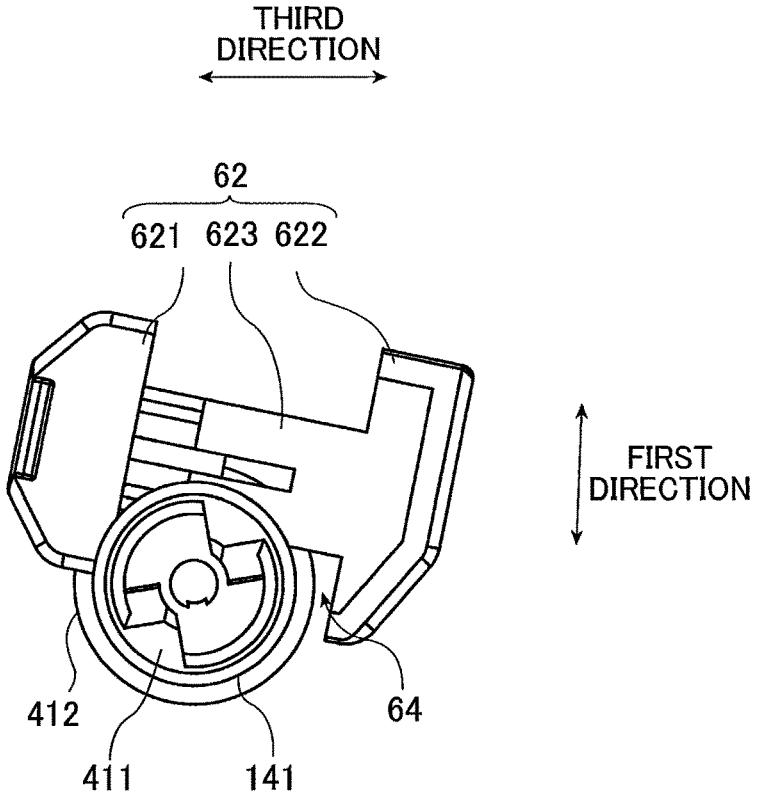
FIG. 21 is a view of the chip holder and the coupling of FIG. 20 as viewed in the second direction.

FIGS. 20 and 21 illustrate a positional relationship between the chip holder 62 and the coupling 141 according to the fourth modification.

Similar to the second embodiment, the coupling 141 according to the fourth modification is connected to the coupling gear 412 through the shaft 413. Regardless of the first position and the second position of the chip holder 62, a portion of the coupling 141 can be positioned between the first holder 621 and the second holder 622 as the shaft 413 is positioned in the space 64 of the chip holder 62. Further, regardless of the first position and the second position of the chip holder 62, the shaft 413 is positioned away from the connecting portion 623 in a state where the portion of the coupling 141 is positioned between the first holder 621 and the second holder 622. Placing the shaft 413 in the space 64 can position the coupling 141 closer to the chip holder 62 in the first direction than the coupling 41 is to the chip holder 62 in the first embodiment. Hence, the coupling 141 can be so positioned that overlap between the first holder 621 and the second holder 622, and the coupling 141 in the first direction can be made greater in this modification than in the first embodiment. As a result, the first holder 621 and the second holder 622, and the coupling 141 can be further positioned closer to each other in the first direction in this modification than in the first embodiment.

<4.5. Other Modifications>

Further, in the above-described embodiments, the coil spring 63 is employed as a resilient member. However, in place of the coil spring 63, other types of spring, such as a leaf spring or a torsion spring, may be available as the resilient member. Alternatively, the resilient member may be a rubber, for example. Further, in the above-described embodiments, the coil spring 63 is configured to expand and contract. However, the resilient member may be configured either to expand or, alternatively, to contract as long as the resilient member is resiliently deformable. Note that the expression "the resilient member is resiliently deformable" implies that the resilient member is capable of either expanding or contracting or both. That is, the resilient member is configured to expand and/or contract in the third direction between the first state and the second state. In other words, the resilient member is configured to change its length in the third direction to provide the first state and the second state. Put another way, the resilient member has any one of expansion properties for expanding in the third direction, contraction properties for contracting in the third direction, and expansion-contraction properties for expanding and contracting in the third direction to provide the first state and the second state.

Further, in the above-described embodiments, the chip 61 having the electrical contact surface 611 is fixed to the outer surface of the chip holder (first holder). However, only the electrical contact surface for contacting the electrical connector may be fixed to the outer surface of the first holder, while remaining components of the chip other than the electrical contact surface may be fixed to other portion of the developing cartridge.

Further, components used in the above-described embodiments and the modifications may be suitably combined together without conflict in the essential concept of the disclosure.

What is claimed is:

1. A developing cartridge comprising:

a casing configured to accommodate developer;

a developing roller positioned at one end portion of the casing in a first direction, the developing roller being rotatable about a first axis extending in a second direction;

a storage medium having an electrical contact surface;

a first holder movable in the first direction relative to the casing, the first holder having an outer surface at which the electrical contact surface is held;

a second holder movable together with the first holder in the first direction relative to the casing, the second holder being positioned away from the first holder in a third direction crossing the electrical contact surface; and a coupling rotatable about a second axis extending in the second direction, the coupling being rotatable together with the developing roller, wherein the first holder and the second holder are movable relative to the casing and the coupling between a first position in the first direction and a second position in the first direction, the second position being positioned closer to the developing roller than the first position is to the developing roller, and wherein a portion of the coupling is positioned between the first holder and the second holder in a case where the first holder and the second holder are positioned at the second position.

2. The developing cartridge according to claim 1, further comprising a resilient member positioned between the first holder and the second holder, the resilient member being configured to expand and/or contract in the third direction between a first state and a second state, the resilient member in the first state having a length in the third direction greater than a length in the third direction of the resilient member in the second state, wherein the first holder is movable in the third direction relative to the second holder between a third position and a fourth position in accordance with expansion and/or contraction of the resilient member, the first holder being positioned at the third position in a case where the resilient member is in the first state, and the first holder being positioned at the fourth position in a case where the resilient member is in the second state.

3. The developing cartridge according to claim 1, wherein the portion of the coupling is positioned between the first holder and the second holder in a case where the first holder and the second holder are positioned at the first position.

4. The developing cartridge according to claim 1, further comprising a connecting portion extending in the third direction and connecting the first holder and the second holder to each other, the connecting portion having a length in the first direction smaller than a length in the first direction of the first holder and a length in the first direction of the second holder, wherein, in a case where the first holder and the second holder are positioned at the second position, the portion of the coupling is positioned away from the connecting portion in a state where the portion of the coupling is positioned between the first holder and the second holder.

5. The developing cartridge according to claim 4, wherein, in a case where the first holder and the second holder are positioned at the first position, the portion of the coupling is positioned away from the connecting portion in a state where the portion of the coupling is positioned between the first holder and the second holder.

6. The developing cartridge according to claim 1, wherein the casing has an outer surface in the second direction, the coupling being positioned away from the outer surface of the casing in the second direction, the developing cartridge further comprising:

a developing-roller gear positioned at the one end portion of the casing, the developing-roller gear being rotatable together with the developing roller;

a coupling gear meshing with the developing roller gear; and a shaft extending in the second direction, the shaft connecting the coupling and the coupling gear to each other, the shaft having a diameter smaller than a diameter of the coupling and a diameter of the coupling gear, wherein the portion of the coupling is positioned between the first holder and the second holder in a state where at least one of a portion of the first holder and a portion of the second holder is positioned between the coupling and the coupling gear.

7. The developing cartridge according to claim 6, wherein one of the first holder and the second holder has a through-hole extending in the second direction, and wherein the portion of the coupling is positioned between the first holder and the second holder in a state where the shaft is inserted into the through-hole.

8. The developing cartridge according to claim 6, further comprising a connecting portion extending in the third direction and connecting the first holder and the second holder to each other, the connecting portion having a length in the first direction smaller than a length in the first direction of the first holder and a length in the first direction of the second holder, wherein, in a case where the first holder and the second holder are positioned at the second position, the shaft is positioned away from the connecting portion in a state where the portion of the coupling is positioned between the first holder and the second holder.

9. The developing cartridge according to claim 8, wherein, in a case where the first holder and the second holder are positioned at the first position, the shaft is positioned away from the connecting portion in a state where the portion of the coupling is positioned between the first holder and the second holder.

10. The developing cartridge according to claim 1, further comprising a shaft extending in the second direction and connected to the coupling, wherein one of the first holder and the second holder has a through-hole extending in the second direction, the through-hole having a length in the first direction and a length in the third direction that are greater than a diameter of the shaft, and wherein the portion of the coupling is positioned between the first holder and the second holder in a state where the shaft is inserted into the through-hole.

11. The developing cartridge according to claim 1, wherein the coupling has a recessed portion that is recessed in the second direction.

12. The developing cartridge according to claim 1, wherein the coupling is configured to receive a driving force, and wherein the developing roller rotates in response to the driving force received by the coupling.

13. The developing cartridge according to claim 1, further comprising:

a developing-roller gear rotatable together with the developing roller; and a coupling gear meshing with the developing roller gear, the coupling gear being rotatable together with the coupling.

14. The developing cartridge according to claim 1, wherein the storage medium is positioned at the outer surface of the first holder.

15. A developing cartridge comprising:

a casing configured to accommodate developer;

a developing roller positioned at one end portion of the casing in a first direction, the developing roller being rotatable about a first axis extending in a second direction;

a storage medium having an electrical contact surface;

a first holder movable in the first direction relative to the casing, the first holder having an outer surface at which the electrical contact surface is held;

a second holder movable together with the first holder in the first direction relative to the casing, the second holder being positioned away from the first holder in a third direction crossing the electrical contact surface; and a coupling rotatable about a second axis extending in the second direction, the coupling being rotatable together with the developing roller, wherein one of the first holder and the second holder has a through-hole extending in the second direction, and wherein the first holder and the second holder is movable in the first direction relative to the casing and the coupling in a state where the coupling is inserted into the through-hole.

16. The developing cartridge according to claim 15, wherein the first holder and the second holder are movable relative to the casing and the coupling between a first position in the first direction and a second position in the first direction, the second position being positioned closer to the developing roller than the first position is to the developing roller.

17. The developing cartridge according to claim 15, further comprising a resilient member positioned between the first holder and the second holder, the resilient member being configured to expand and/or contract in the third direction between a first state and a second state, the resilient member in the first state having a length in the third direction greater than a length in the third direction of the resilient member in the second state, wherein the first holder is movable in the third direction relative to the second holder between a third position and a fourth position in accordance with expansion and/or contraction of the resilient member, the first holder being positioned at the third position in a case where the resilient member is in the first state, and the first holder being positioned at the fourth position in a case where the resilient member is in the second state.

18. The developing cartridge according to claim 15, wherein the first holder has the through-hole.

19. The developing cartridge according to claim 15, wherein the second holder has the through-hole.

20. The developing cartridge according to claim 15, wherein the coupling has a recessed portion that is recessed in the second direction.

21. The developing cartridge according to claim 15, wherein the coupling is configured to receive a driving force, and wherein the developing roller rotates in response to the driving force received by the coupling.

22. The developing cartridge according to claim 15, further comprising:

a developing-roller gear rotatable together with the developing roller; and a coupling gear meshing with the developing roller gear, the coupling gear being rotatable together with the coupling.

23. The developing cartridge according to claim 15, wherein the storage medium is positioned at the outer surface of the first holder.

24. The developing cartridge according to claim 15, wherein the through-hole has a length in the first direction and a length in the third direction that are greater than a diameter of the coupling.

25. A developing cartridge comprising:

a casing configured to accommodate developer;

a developing roller positioned at one end portion of the casing in a first direction, the developing roller being rotatable about a first axis extending in a second direction;

a storage medium having an electrical contact surface;

a first holder movable in the first direction relative to the casing, the first holder having an outer surface at which the electrical contact surface is held;

a second holder movable together with the first holder in the first direction relative to the casing, the second holder being positioned away from the first holder in a third direction crossing the electrical contact surface;

a coupling rotatable about a second axis extending in the second direction, the coupling being rotatable together with the developing roller; and a resilient member positioned between the first holder and the second holder, the resilient member being configured to expand and/or contract in the third direction between a first state and a second state, the resilient member in the first state having a length in the third direction greater than a length in the third direction of the resilient member in the second state, wherein one of the first holder and the second holder has a through-hole extending in the second direction, and wherein the first holder is movable in the third direction relative to the second holder between one position and another position in accordance with expansion and/or contraction of the resilient member in a state where the coupling is inserted into the through-hole, the first holder being positioned at the one position in a case where the resilient member is in the first state, and the first holder being positioned at the another position in a case where the resilient member is in the second state.

26. The developing cartridge according to claim 25, wherein the first holder has the through-hole.

27. The developing cartridge according to claim 25, wherein the second holder has the through-hole.

28. The developing cartridge according to claim 25, wherein the coupling has a recessed portion that is recessed in the second direction.

29. The developing cartridge according to claim 25, wherein the coupling is configured to receive a driving force, and wherein the developing roller rotates in response to the driving force received by the coupling.

30. The developing cartridge according to claim 25, further comprising:

a developing-roller gear rotatable together with the developing roller; and a coupling gear meshing with the developing roller gear, the coupling gear being rotatable together with the coupling.

31. The developing cartridge according to claim 25, wherein the storage medium is positioned at the outer surface of the first holder.

32. The developing cartridge according to claim 25, wherein the through-hole has a length in the first direction and a length in the third direction that are greater than a diameter of the coupling.

* * * * *